US006337304B1

(12) United States Patent
Yoshizawa et al.

(10) Patent No.: US 6,337,304 B1
(45) Date of Patent: Jan. 8, 2002

(54) THERMAL TRANSFER RECORDING MATERIAL

(75) Inventors: Tomomi Yoshizawa; Hiroshi Watanabe; Yorihiro Yamaya; Motoaki Sugino; Masaki Nakamura; Atsushi Tomotake; Kaori Fukumuro, all of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/408,843

(22) Filed: Sep. 30, 1999

(30) Foreign Application Priority Data

Oct. 1, 1998 (JP) ..... 10-279661
Dec. 22, 1998 (JP) ..... 10-376298
Mar. 8, 1999 (JP) ..... 11-060123

(51) Int. Cl.[7] ..... B41M 5/035; B41M 5/38
(52) U.S. Cl. ..... 503/227; 428/913; 428/914
(58) Field of Search ..... 503/227; 428/195, 428/913, 914; 8/471

(56) References Cited

U.S. PATENT DOCUMENTS 5,322,832 A * 6/1994 Takeyama et al. ..... 503/227
5,330,961 A * 7/1994 Takeyama et al. ..... 503/227
5,358,922 A * 10/1994 Nakayama et al. ..... 503/227
5,837,649 A * 11/1998 Nozaki ..... 503/227

* cited by examiner

*Primary Examiner*—Bruce H. Hess
(74) *Attorney, Agent, or Firm*—Finnegan, Henderson, Farabow, Garrett and Dunner, L.L.P.

(57) ABSTRACT

An image receiving sheet characterized by comprising an image receiving layer composed of a metal ion containing compound capable of forming chelate with a thermally transferable dye and an acryl resin composed of styrene and acrylonitrile as component unit, and an image forming method employing it are disclosed. Discoloration or smudge are prevented, glossiness is excellent, dye acceptability is high and image storage stability is good.

17 Claims, 1 Drawing Sheet

THERMAL TRANSFER RECORDING MATERIAL

BACKGROUND OF THE INVENTION

The present invention relates to an image recording material in which an image is formed by sublimating thermally transferable dyes, and more specifically to the image recording material comprising an image receiving sheet which gives an image having excellent surface glossiness, high acceptability of dyes, stiffness comparative to a silver halide photographic color paper, reduced incompatibility when affixed on a board or reduced curling characteristics without discoloration or smudge, and an ink sheet which is high sensitive and good in color reproduction and contains a dye giving an image having good image stability.

As a color or monochrome image forming technology, the technology has been known in that an ink sheet containing a thermal transferable dye such as a sublimable dye is in contact with an image-receiving layer of a image-receiving element and is heated by a thermal head, etc. so that the sublimable dye described above is transferred imagewise to the image-receiving layer. The image recording method is a digital image recording method which is capable of reproducing image quality parallel to a conventional silver halide photography, and a printer, and an ink sheet and an image receiving sheet have been developed in resent years. However the image formed by the sublimable dye has, despite of good image quality, a problem of poor image storage stability, particularly it is liable to discolor by light or smudge.

A binder composing of the image receiving layer has been studied in order to improve the image storage stability formed by sublimation dye transfer method hitherto. A technology is disclosed in Japanese Patent Open to Public Publication (JP-A) No. 36-319188 that an image receiving material having good image storage ability is obtained by employing a copolymer resin comprising acrylonitrile and styrene as an essential component, which has not brought satisfactory result and has raise a problem of reducing image density.

On one hand, a post chelate dye image formed by reacting a post chelate dye as the sublimable dye with a metal ion containing compound (metal source) improves image storage stability markedly in comparison with the conventional dye image. It is known that the higher the chelating ratio of bonding the chelate dye supplied from the ink sheet to the metal source in the image receiving layer, the more stable the post chelate dye image is. The image receiving sheet formed by the post chelate dye does not produce discloration or smudge and is excellent in stability against light in comparison with the conventional sublimable dye image when it is stored for a long time.

While the image employing the post chelate dye is better than the conventional sublimable material, it has a problem that it is affected by oxygen or moisture in the air sintered into the image receiving layer and the storage stability is deteriorated by that the chelate dye decomposed by oxygen or moisture when it is stored in s severe circumstances for long period.

As the high definition image receiving sheet parallel to the convnetional silver halide photography, those causing no image defects during the image forming, and having excellent surface glossiness of the image receiving layer, high acceptability of dyes, stiffness comparative to a silver halide photographic color paper, and reduced incompatibility when affixed on a board or reduced curling characteristics.

SUMMARY OF THE INVENTION

The object of the present invention is to provide a image receiving material which does not cause discoloration or smudge of image and is excellent in glossiness and high accepting ability of dye (i.e., high sensitivity) even though it is stored under severe circumstances such as high temperature and high humidity for ling period.

The thermally transferable recording material and its embodiments of the invention are described.

A thermally transferable recording material to form an image by sublimating a thermally transferable dye, which material comprises an image receiving sheet capable of accepting thermally transferable dye and having a first support and an image receiving layer provided on the first support, wherein the image receiving layer comprises a metal ion containing compound capable of forming chelate with the thermally transferable dye and an acryl resin composed of styrene and acrylonitrile as component unit.

The metal ion containing compound described above is preferably that represented by MX. Here M is a monovalent or poly valent metal belong to Group I through Group VIII of the periodic table, X represents

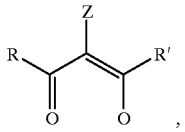

wherein Z is an alkyl, aryl, alkoxy, acyl, alkoxycarbonyl, carbamoyl group, a halogen or hydrogen atom; R and R' represent an alkyl or aryl group, each of which may be same or different, ring may be formed by boding R with Z or R' with Z, with proviso that R and R' are not methyl group simultaneously when Z is hydrogen atom.

It is preferred that the acryl resin described above comprises acrylonitrile-styrene resin.

The first support preferably comprises a porous resin layer.

It is preferred that the first support further comprises a paper layer, and that the porous resin layer is provided between the paper layer and the image receiving layer.

It is also preferred that the image receiving sheet comprises a coating layer of aqueous dispersion of resin on an opposite side of the porous resin layer with reference to the paper layer.

The coating layer of aqueous dispersion of resin is preferably a hardenable resin.

The image receiving sheet preferably comprises a back resin layer having higher elastic modulus than tensile elastic modulus of the porous resin layer on an opposite side of the porous resin layer with reference to the paper layer.

It is preferred that the porous resin layer contains polyester.

The polyester is preferable to contain polyethyleneterephthalate.

Tensile elastic modulus of the backing resin layer is preferably more than 1.5 times of that of the porous resin layer.

It is more preferable the tensile elastic modulus of the backing resin layer more than 2.0 times of that of the porous resin layer.

The porous resin layer preferably has specific gravity of 0.5 to 0.9.

It is preferred that the image receiving sheet comprises a back coat layer containing fine particles of inorganic or organic compound and binder on opposite side concerning overlay surface of the porous resin layer.

The back coat layer preferably contain an antistatic agent.

The thermal transfer recording material preferably comprises an ink sheet comprising a second support and an ink layer provided on the second support, and the ink sheet contains the thermally transferable dye.

It is preferable that the thermally transferable dye is that represented by the formula (I) shown below.

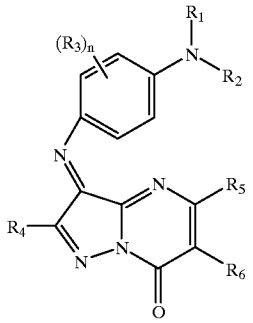

In the formula, R1 and R2 independently represent a substituted or non-substituted alkyl group, R3 represents a substituent. n is an integer of 0 to 4, R3 may be same or different when n is 2 or more. R4 is a straight chain alkyl group having two or more carbon atoms, a cycloalkyl, branched alkyl (excepting tertiary alkyl), aryl, alkoxy, aryloxy or amino group. R5 and R6 independently represent a hydrogen atom or a substituent.

In the Formula I, R4 or R5 is preferably an aryl group having a substituent at ortho position.

In the Formula I, at least one of R4, R5 and R6 is preferably a branched, but not tertiary, alkyl group.

DESCRIPTION OF THE INVENTION

Figure 1:
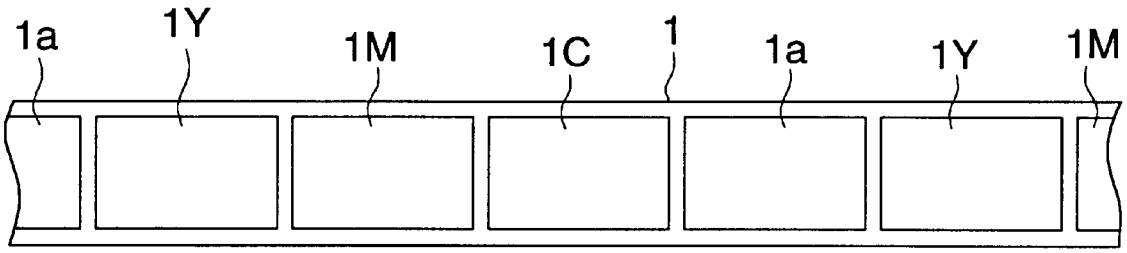
FIG. 1 shows top view of an embodiment of arranging dye containing area and dye non-containing area in the ink sheet employed in the present invention.

The image-receiving sheet of the thermal transfer recording material of the present invention is composed of at least a support and an image-receiving layer formed on the support.

The supports for the image-receiving element may include, for example, various kinds of paper such as paper, coat paper and synthetic paper (composite material in which paper is laminated on polyethylene, polypropylene, polystyrene, etc.); various kinds of plastic films or sheets such as vinyl chloride series plastic sheet, ABS resin sheet, polyethylene terephthalate base film, polyethylene naphthalate base film, etc.; film or sheet made of various kinds of metals; film or sheet made of various kind of ceramics, etc.

The support preferably comprises one or plural porous resin layer.

It is preferred to employ the paper mentioned above in combination in case that the support of the image receiving layer comprises a porous resin layer. The paper employed as the support preferably is stiff one. Particularly high quality paper having weight of 110 to 200 g/m$^2$ and thickness of 90 to 180 $\mu$m is preferable.

It is preferred to provide a coating layer of aqueous dispersion liquid of resin on the opposite side to the side having image receiving layer, or a backing resin layer having higher tensile elastic modulus than that of the porous resin layer in case that the paper is employed in combination with porous resin layer as the support of the image receiving sheet in the present invention.

The aqueous dispersion liquid of resin is liquid containing a resin dispersed in water as fine particle state. A method of progressing polymerization reaction while monomer is made to be dispersed in water is employed generally to prepare the aqueous dispersion liquid of resin, wherein a surfactant is employed to disperse the monomer. Preferable surfactant is an anionic surfactant. It is preferable to contain a polymerization initiator such as radical polymerization initiator in dispersant. Polypropylene, polyurethane, saturate polyester, polyacrylic ester, polyacrylonitrile, polystyrene, alkyd resin, SBR, ABS resin are cited as the preferable examples of the resin.

A hydrophobic binder is preferably employed for a coating composition to provide an aqueous dispersion coating layer in view of preventing curling. The hydrophobic binder is preferably a hardening resin such as a thermal hardening resin, electron ray hardening resin, UV ray hardening resin. It is advantageous in reducing curl variation, particularly controlling curl variation at high temperature and high moisture by employing the hardening resin. The coating layer preferably has linear tensile strength of more than 100 kg/cm$^2$ in a dry state. The thickness of the coating layer is preferably 2 to 60 $\mu$m.

It is preferred to incorporate inorganic fine particles in the aqueous resin dispersion coating layer to give the image receiving layer writing ability. Porous silica, alumina, clay, talc, diatom earth, calcium carbonate, baked kaolin, titania, zinc oxide and satin white are cited preferable as the preferable examples of the inorganic fine particles. Ratio of the resin to the inorganic fine particles is 80/20 to 40/60 (resin/inorganic fine particles) by weight in a dry state, and the amount to be contain is 20 to 60% with reference to weight of solid parts of the coating layer.

It is preferred to incorporate an antistatic agent in the aqueous resin dispersion coating layer as it improves conveying characteristics at the printing time. Cationic surfactant, anionic surfactant, nonionic surfactant, polymer antistatic agent, electric-conductive fine particle compound, and, in addition thereto, compounds described in "11290 Chemical Articles" pages 875 to 876, Kagaku Kogyo Nipposha, are widely employed as the antistatic agent. The preferable examples of the antistatic agent are carbon black; metal oxide such as zinc oxide, titan oxide and stannic oxide; and electro-conductive fine particles such as semiconductor fine particles, and among these, electro-conductive fine particles are preferable as they are not release from the coating layer of the antistatic agent and give stable antistatic effect independently from environment change. Amount of the antistatic agent to be contain is 3 to 30% of solid parts of the coating layer.

Various active agents, releasing agent such as silicone oil and fluoride resins may be added to the aqueous dresin dispersion coating layer so as to give coating ability and releasing ability. Coating methods such as roll coating, wire bar coating, air knife coating etc. are applied.

Tensile elastic modulus of the backing resin layer is preferably more than 1.5 times, more preferably 2.0 times or more as that of the porous resin layer, as curl variation by moisture is depressed when the image receiving sheet is made thinner, and in view of cost.

Tensile elastic modulus can be measured by the following way. Sample is prepared by cutting 10 mm width and 150 mm longitude. Stress and extended length are measured by Tensilon tensile tester to obtain tensile elastic modulus.

As the examples of the resin to form the backing resin layer, polyester such as polyethylene terephthalate, polybutylene terephthalate and polyethylenenaphthalate, and polycarbonate, polyarylate, phenoxy resin, 66 nylon etc. are cited.

It is preferred that the backing resin layer does not substantially contain voids inner of the layer, as curl variation by moisture is depressed when the image receiving sheet is made thinner, and in view of cost.

It is preferred that the backing resin layer is stretched, as curl variation by moisture is depressed when the image receiving sheet is made thinner, and in view of cost, particularly it is formed by biaxial stretching.

It is preferred that the specific gravity of the backing resin layer is 1.0 or more, as curl variation by moisture is depressed when the image receiving sheet is made thinner, and in view of cost.

It is preferred that the thickness of the backing resin layer is thinner than that of the porous resin layer, as the image receiving sheet can be made thinner, and in view of cost.

It is preferred that a back coat layer is provided on opposite side concerning overlay surface of the porous resin layer, and the back coat layer is preferably comprises inorganic or organic fine particles and binder.

Hydrophobic resin and hydrophilic resin are cited as the binder, and the hydrophobic binder is preferable.

Polyester based binder is preferable when polyester is employed for the backing resin layer. The binder resin may be coated as coating solution dissolved in a solvent or aqueous latex dispersion, and preferably latex dispersion is employed.

As the binder resin, polyester, polyacrylate, poly methacrylic acid ester, styrene-acrylonitrile copolymer, styrene-acrylate copolymer, ABS, SBR, urethane resin are cited.

Water soluble resin may be employed for the binder. Polyvinyl alcohol, gelatin, polyvinylpyrrolidone, water-soluble polyester, casein, starch, carboxymetyl-cellulose, hydroxyethyl cellulose, polyethylene glycol are cited as the water soluble resin.

White pigment is cited as the inorganic fine particles. The examples of the white pigment include silica, clay, talc, calcium carbonate, diatom earth, baked kaolin, titania, zinc oxide, barium sulfate. Particle diameter of the white pigment is preferably 0.5 to 10 $\mu$m. Amount to be added is preferably 5 to 40 weight % of total weight of solid parts of back coat layer.

As the organic fine particle, electro-conductive fine particle such as organic semiconductor. The amount to be added is preferably 5 to 40 weight % of total weight of solid parts of back coat layer.

It is preferred the back coat layer comprising inorganic or organic fine particles and a binder contains the antistatic agent that may be employed in the aqueous resin dispersion layer in the similar way described above.

It is preferred to incorporate in the support white pigment such as titan white, magnesium carbonate, zinc oxide, barium sulfite, silica, clay and calcium carbonate to enhance the clearance of the image when the support is composed of a material other than metal or ceramics, particularly is composed of synthesized paper. The adequate thickness of the support is usually 20 to 1000 $\mu$m, preferably 20 to 800 $\mu$m.

A porous resin layer is a layer containing void such as air bubble. To incorporate the bubble certain resin and a substance immiscible in the resin are mixed, the mixture is extruded and stretched. Or a thermally expandable hollow particle or a capsule-shaped hollow resin particle can be used. Moreover, a decomposition type foaming agent, such as dinitropentamethylenetetramine, diazoaminobenzene, azobisisobutylnitryl and azodicarboamide, which generates a gas such as oxygen, carbon dioxide gas or nitrogen, by heating.

The foams contained in the layer are preferably independent foams from the viewpoint of ability of cushion and heat insulation, for example, that described in JP-A. No. 6-270559 is preferable.

Although an adhesive may be contained in the foam-containing layer, a primer layer may be provided between the support and the foam-containing layer to enhance the adhesion between them. A primer layer described in JP-A. No. 5-270152 can be used such the primer layer.

It is preferred to make the specific gravity of 0.3 to 0.8 by the processing to contain air bubbles in the resin, in comparison with the resin containing no air bubbles as itself.

Resin to form porous resin layer is preferably polypropylene or more preferably polyester, in view of glossiness of the image and curling. The polyester referred here is a polymer obtained by condensation polymerization of diol and dicaboxylic acid. As the examples of the dicarboxylic acid, terephthalic acid, isophthalic acid, phthalic acid dinaphthalenecaboxylic acid etc. are cited. As the examples of diol, ethylene glycol, trimethylene glycol, tetramethylene glycol, cyclohexane dimethanol etc. are cited. Polyethylene-terephthalate (PET) is preferable among the polyester.

The porous resin layer preferably has a thickness of 20 to 20 $\mu$m, and specific gravity of 0.5 to 0.9. It may be formed by a single layer, and preferably, may be multi-layer structure having different specific gravity in view of preventing curling and giving cushion property.

Simultaneous extrusion stretching is preferable as the preparation method of porous resin layer.

The image-receiving layer is not specifically restricted as far as it accepts a dye which is diffused upon heating from the ink layer of the ink sheet. The image-receiving layer is basically composed of a binder various and.

As a method to form the image-receiving layer on the surface of the support, a coating method can be illustrated in that a coating liquid is prepared by dispersing or dissolving components forming the image-receiving layer and coat dried on the surface of the above-mentioned support, or a laminating method can be illustrated in that a mixture containing components forming the above-mentioned image-receiving layer is laminated on the surface of the support employing melt extrusion. The thickness of the image-receiving layer formed on the surface of the support is usually in the range of from 0.5 to 50 $\mu$m and preferably from 1 to 20 $\mu$m.

As the binder for an image-receiving layer, an acrylic resin having composing unit of styrene and acrylonitrile.

As the examples of acryl resin having styrene and acrylonitrile as structural unit, acrylonitrile-styrene copolymer (AS resin), acrylonitrile-special acrylic rubber-styrene copolymer (AAS resin), acrylonitrile-ethylene propylene rubber-styrene copolymer (AES resin), acrylonitrile-butadiene rubber-styrene copolymer (ABS resin), acrylonitrile-chlorinated polyethylene-stylene copolymer (ACS resin) are cited. Those having thermal deformation temperature of 60 to 120° C. are preferable in image storage stability among these resins. These resins have good compatibility with particularly a sublimation dye which is capable of chelate with a metal ion compound or a dye after chelate reaction, and are capable of forming image having excellent in storage stability for long time at severe condition such as high humidity and in fastness against light since they do not diffuse or decompose depending on environmental change. Among the resin described above the AS resin is employed most preferably. Acrylonitrile containing ratio in the acryl resin containing acrylonitrile as an essential component is preferably 10 to 50%, and further preferably 15 to 30%. The followings are articles in market. Tyril-767, 769, 789,783, Stylac 709, 727 (manufactured by Asahi Chemical Industry Co., LTD.), Estyrene AS series (manufactured by Shin Nittetsu Kagaku Co., LTD.), Sebian series (manufactured by Daicel Chemical Industry Co., LTD.), Rytac series (manufactured by Mitsui Chemical Industry Co., LTD.), Sunrex SAN-C, San-H, coolimate S-325, S-320, S-315 (manufactured by Mitsubishi Monsant Chemical Industry Co., LTD.). As the examples of AAS resin, Bitax series, Bifnen series (manufactured by Hitachi Chemical Industry Co., LTD.) are cited. As the examples of AES resin, Unibright series (manufactured by Sumitomo Norgatac Co., LTD.), JSRAES series (manufactured by Nippon Synthetic Industry Co., LTD.) are cited. As the ACS resin, ACS resin NF series (manufactured by Showa Denko K. K.) is cited. The most preferably employed is the AS resin.

The resins described be low may be employed by mixing in combination with the acrylonitrile resin in the invention.

Polyvinylbutyral resins may be employed in combination. The polyvinyl butyral is a copolymer of vinylbutyral and butylalcohol manufactured by reacting polyvinylalcohol with butylaldehyde. In the present invention polyvinyl butyral having butyral degree of 75 mol % or more and nonsaponified vinylacetate group of 10 mol % or less is employed.

In addition to the above, examples of resin usable as the binder include a vinyl chloride resin, a polyester resin, a polycarbonate resin, an acryl resin, a polyvinyl acetal resin, and various kinds of heat resistive resin.

Although the kind of resin can be optionally selected, a poly(vinyl acetal) resin or a vinyl chloride resin are preferred from the viewpoint of the storage ability of image. As the polyvinylacetal resin, polyvinylacetoacetal resin, polyvinylbutyral resin and polyvinylformal resin are preferable. As the polyvinylchloride resin, a polyvinyl chloride resin and a copolymer of vinyl chloride are preferable. Example of the vinyl chloride copolymer is a copolymer composed of not less than 50 mole-% of vinyl chloride monomer and another co-monomer. Other than the vinyl chloride resin and, a polyester resin can also be used suitably as the image receiving layer for thermal transfer recording. For example, poly(ethylene terephthalate), poly(butylene terephthalate, compounds described in JP-A. Nos. 58-188695 and 62-244696, are usable as the polyester resin. As the polycarbonate resin, for example, compounds described in JP-A. No. 62-169694 are usable. As the acryl resin, for example, a polyacrylate is usable. As the heat resistive resin, various kinds of heat resistive resin are usable as long as the resin has a not excessive low softening point or glass transition point Tg, and a suitable miscibility with the foregoing vinyl chloride resin, and is substantially not colored. The "heat resistive resin" means a resin which is not yellow colored and the physical properties thereof is not extremely degraded when the resin is stored under a high temperature. As the heat resistive resin, one having a Tg of from 30° C. to 200° C., particularly from 50° C. to 150° C., is preferable. Examples of the heat resistive resin satisfying the foregoing condition include a phenol resin, a melamine resin, a urea resin and a ketone resin. Among them, the urea-aldehyde resin and the ketone resin are particularly preferred. The urea-aldehyde resin can be obtained by condensation of urea and an aldehyde, principally formaldehyde, and the ketone resin can be obtained by condensation reaction of a ketone and formaldehyde.

Furthermore, the following resins can be used in combination.

A polyolefin resin such as polypropylene, a vinyl halide resin other than the above-mentioned such as poly (vinylidene chloride), a vinyl polymer other than the above-mentioned such as poly(vinyl acetate), a polystyrene resin, a polyamide resin, a copolymer resin of an olefin such as ethylene or propylene and a vinyl monomer, an ionomer, a cellulose resin such as cellulose diacetate, a polyurethane resin, a polyimide resin and an epoxy resin.

A polyurethane resin and polyester resin described in JP-A. Nos. 5-246152, 5-64978,4-299184, 4-43082, and 5-270151; a polyvinylacetal resin described in JP-A. Nos. 5-246151 and 5-294076; a vinyl chloride copolymer containing an epoxy group described in JO O.P.I. No. 5-246150, a random copolymerized polycarbonate resin described in JP-A. No. 5-131758; a polyamide resin described in JP-A. Nos. 4-299187 and 4-299188; a water-soluble resin composed of a hydrophobic resin liquid described in JP-A. No. 4-347690; a synthesized resin described in JP-A. No. 4-131287, copolymer and a reaction product described in JP-A. No.4-135794, 6-15966, 58-215398, 61-19997, 2-178089, 2-86494, 1-160681, 1-123794, 3-126587, and 6-8646, acidic resin having acid value of 2 or more described in JP-A. No. 2-107485, and a mixture of a dispersion of water-insoluble or slightly-soluble polyester resin and an aqueous dispersion of another thermoplastic resin described in JP-A. No. 6-79974.

In forming the image receiving layer various resins mentioned above may be cross-linked or hardened utilizing the reactive group thereof by radiation, heat, moisture or a catalyst, when the resin has no reactive group the reactive group can be given. In such the case, a radiation reactive monomer such as an epoxy compound or an acryl compound and a cross-linking agent such as an isocyanate compound may be used. Such the monomer and the cross-linking agent may be added into the image receiving layer directly or in a form of closed in a microcapsule.

The image receiving layer of the invention contains a compound containing metal ion capable of reacting with a thermally diffusable dye, which is referred to "a metal source" hereafter, in the binder resin.

An inorganic or organic salt or complex salt of a metal ion is usable for the metal source, among them an organic acid salt and complex salt are preferable. Monovalent and polyvalent metal of Group I through Group VIII of the periodic table is usable as the metal. Al, Co, Cr, Cu, Fe, Mg, Mn, Mo, Ni, Sn, Ti and Zn are preferable and Ni, Cu, Cr, Co and Zn are particularly preferable. Practical examples of the metal source include salts of $Ni^{2+}$, $Cu^{2+}$, $Cr^{2+}$ and $Zn^{2+}$ of an aliphatic carboxylic acid such as acetic acid and stearic acid and aromatic carboxylic acid such as benzoic acid and salicylic acid. A complex salt represented by the following formula MX is particularly preferred since the compound can be stably added into the image receiving layer and the compound is substantially colorless. M is a metal belonging to Groups I to VIII of the periodic table, and X is

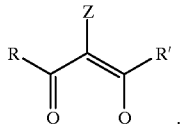

Z represents an alkyl, aryl, alkoxy, acyl, alkoxycarbonyl, aryloxy carbonyl, or carbamoyl group, or a halogen or hydrogen atom. R and R' represents an alkyl or aryl group, and each of them may be same or different, and R and Z or R' and Z may form ring by bonding each other, with proviso that R and R' are methyl group at the same time in case that Z is a hydrogen atom.

The compounds are exemplified.

| No | M | X |
|---|---|---|
| MS-1 | Ni | 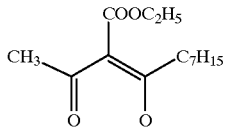 |
| MS-2 | Ni | 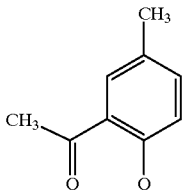 |
| MS-3 | Ni | 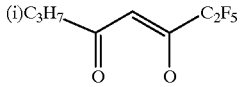 |
| MS-4 | Ni | 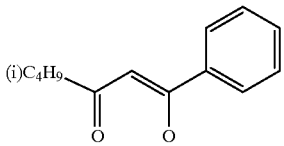 |
| MS-5 | Zn | 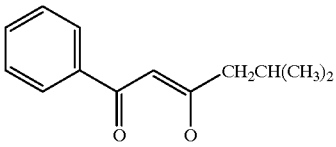 |
| MS-6 | Zn | 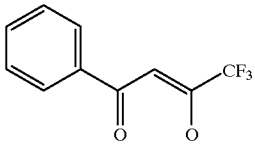 |
| MS-7 | Cu | 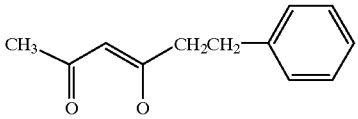 |

-continued

| No | M | X |
|---|---|---|
| MS-8 | Cu | 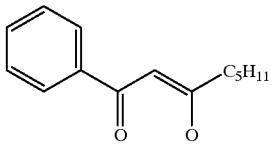 |

The metal source is preferably added into the image receiving layer in an amount of from 5% to 80%, more preferably from 10% to 70%, by weight of the binder of the image receiving layer. When the amount of the metal source is excessive, the color of the metal source is appeared on the white background of the image receiving element.

A mold releasing agent, an antioxidant, a UV absorbent, a filler and a pigment may be added into the image receiving layer. A plasticizer and a thermal solvent may also be added in to the image receiving layer as a sensitizer.

The peeling ability of the image receiving layer from the ink layer of ink sheet can be improved by the addition of the mold releasing agent. Examples of the mold releasing agent are silicone oil including one so called as a silicone resin, a solid wax such as polyethylene wax, propylene wax, amido wax and Teflon powder, a fluorine-containing compound, a silicon-containing compound and a combined composition of them, surfactant such as a fluorine-containing or a phosphate type surfactant, a coupling agent, a compound having a long chain alkyl group and a polyoxyalkyl polyol may be used as the mold releasing agent. Among them the silicone compound is preferred.

The silicone oil is classified into a simply added type (simple addition type) and a hardening or reacting type (hardening-reaction type). In the case of the simple addition type, a modified silicone oil is preferably employed, are illustrated polyester-modified silicone resins (or silicone-modified polyester resins), acryl-modified silicone resins (or silicone-modified acrylic resins), urethane-modified silicone resins (or silicone-modified urethane resins), cellulose-modified silicone resin (or silicone-modified cellulose resins), alkyd-modified silicone resins (or silicone-modified alkyd resins), epoxy-modified silicone resins (or silicone-modified epoxy resins), etc.

As the hardening-reaction type silicone oil, for example, are illustrated modified silicone oil having a reactive group mentioned below.

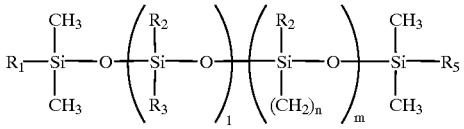

In the above formula, R1 to R5 represent an organic group, mainly is composed of methyl group and may be an alkyl or phenyl group other than the methyl group. Each of 1, m and n is an integer of 1 or more which is provided according to the molecule of the releasing agent adequately. Atomic groups of 1 and m parts are copolymerized randomly.

Silicones described above are employed in combination properly according to their reaction forms. The reaction forms are such that modified silicone having an amino or hydroxyl group reacts with modified silicone having an epoxy, isocyanate or carboxyl group respectively.

Amount of the silicone to be added is, not determined uniformly, 0.2 to 50 weight % to binder in the image receiving layer in general, and preferably 1 to 20 weight %.

The releasing layer may be provided by, for example, coating the releasing agent dissolved or dispersed in an adequate solvent on a part of the surface of the image receiving layer, and then dried. In this instance, solid wax such as polyethylene wax or polypropylene wax are employed preferably, and a resin such as acrylester series, ethyleneacrylic acid series or vinylchloride series may be employed.

As the UV absorbent or light stabilizing agent, ones capable of absorbing UV and being thermally transferred can be used. For example, compounds described in JP-A. Nos. 59-158287, 63-74686, 63-145089, 59-196292, 62-229594, 63-122596, 61-283595 and 1-204788, and known compounds as those which can be improve the storage ability of image in an image recording element such as photograph can be used. The ratio of the binder to the UV absorbent is preferably from 1:10 to 10:1, more preferably from 2:8 to 7:3.

Antioxidants described in JP-A Nos. 59-182785, 60-130735 and 1-127387 and compounds known as antioxidant which can be improve the storage ability of image in an image recording element such as photograph can be used.

As the UV absorbent or light stabilizing agent, ones capable of absorbing UV and being thermally transferred can be used. For example, compounds described in JP-A Nos. 59-158287, 63-74686, 63-145089, 59-196292, 62-229594, 63-122596, 61-283595 and 1-204788, and known compounds as those which can be improve the storage ability of image in an image recording element such as photograph can be used.

As the filler, an inorganic and an organic particle can be used. Examples of the inorganic particle include silica gel, calcium carbonate, titanium oxide, acid clay, active clay, and alumina. Examples of the organic particle include a fluoro resin particle, a guanamine resin particle, an acryl resin particle and a silicone resin particle. These inorganic or organic particles are preferably added in an amount of from 0.1% to 70% by weight even though the amount is varied depending on the specific gravity of the particle. Titanium white, calcium carbonate, zinc oxide, barium sulfate, silica, talc, clay, caolin, acid clay, and active are usable as the pigment.

A phthalate such as dimethyl phthalate, dibutyl phthalate, dioctyl phthalate and didecyl phthalate, a trimellitate such as octyl trimellitate, isononyl trimellitate and isodecyl trimellitate, a pyromellitate such as octyl pyromellitate, and a adipate are usable as the plasticizer. The adding amount of the plasticizer is ordinary within the range of from 0.1% to 30% by weight of the binder of the image receiving layer since an excessive addition of the plasticizer causes degradation in the storage ability of image.

A slippery backing layer may be provided on the back surface of the image receiving sheet. A resin to be used such the purpose is preferably one difficultly to be dyed. Examples of such the resin include an acryl resin, a polystyrene resin, a polyolefin resin, a polyamide resin, polybutyral, polyvinyl alcohol, and a cellulose acetate resin. An amorphous polyolefin resin described in JP-A. No. 7-186557 is also usable. Other than the above-mentioned, a polyvinylbutyral resin, a melamine resin, a cellulose resin and an acryl resin each hardened by a hardening treatment by a chelate, an isocyanate or radiation are also preferable. Examples of the resin available in the market include acryl resins BR85, BR80 and BR113 manufactured by Mitsubishi Rayon Co., Ltd., amorphous polyolefin resins APL6509, 130A, 291AS, and 150R manufactured by Mitsubishi Sekiyu Kagaku-kogyo Co., Ltd., and Zeonex 480, 250 and 480S, manufactured by Nihon Zeon, polyvinylbutyral resin 3000-1, manufactured by Denki Kagaku-kogyo Co., Ltd., polyvinyl alcohol resins manufactured by SMR-20H, SMR-20HH, C-20, C-10, MA-23, PA-20 and PA-15, manufactured by Shin'etsu Kagaku-kogyo Co., Ltd., acetyl cellulose resins L-30 and LT-35, Daicel Kagaku-kogyo Co., Ltd.

An organic and/or inorganic filler may be contained in at least one layer provided on the back surface of the image receiving sheet to improve the suitability for automatic sheet supplier. As the filler, polyethylene wax, bisamide, nylon, acryl resin, cross-linked polystyrene, silicone resin, silicone rubber, talc, calcium carbonate and titanium oxide are usable.

Among the above-mentioned, a nylon filler is particularly preferable for inhibiting frictional wear and change of frictional property by transfer of a sheet supplying rubber roller of a printer.

Preferable a nylon filler has a molecular weight of from 100,000 to 900,000, a shape of sphere and an average particle size of from 0.01 $\mu$m to 30 $\mu$m. One having a molecular weight of from 100,000 to 500,000 and an average particle size of from 0.01 $\mu$m to 10 $\mu$m is particularly preferable. Nylon 12 is preferable compared with the Nylon 6 or Nylon 66, since Nylon 6 is excellent in the water resistivity and property change caused by water absorption is small.

The nylon filler has a high melting point and thermally stable, and is dyed with difficulty by a dye since it has a high resistivity to oil and chemicals. The nylon filler has a self lubricating ability and a low frictional coefficient, and it is almost not worn by friction and does not damage a counter material. The preferable average size is from 0.1 $\mu$m to 30 $\mu$m for an image receiving sheet for reflective image and from 0.01 $\mu$m to 1 $\mu$m for an image receiving sheet for a transparency image. Suitable size of the filler is selected so that sufficient slipping can be obtained and the particle does not largely project from the layer surface.

The above-mentioned fillers are available in the market. For example, polyethylene wax W950 manufactured by Mitsui Sekiyu Kagaku-kogyo Co., Ltd., and nylon filler MW330, manufactured by Shinto Toryo Co., Ltd., are usable. The adding amount of the filler is preferably from 0.01 to 200 parts by weight with respect to 100 parts by weight of resin in the layer to be added.

The center line average surface roughness Ra of the backing layer surface is preferably from 0.5 $\mu$m to 2.5 $\mu$m, and the average number of protrusion per unit area is preferably 2,000 to 4,500 per square millimeter.

Such the property on the surface of the backing layer can be prepared, other than the conditioning by the filler, by a method in which the surface of a cooling roller having such the surface condition is used when the resin is coated by extrusion coating addition so as transfer the condition of the roller surface to the resin layer surface.

An interlayer may be provided between the slippery backing layer and the support sheet to raise the adhesiveness between these layers. The interlayer is preferably formed by a reaction hardened type resin.

A thermally hardenable and/or ionized irradiation hardenable resins described in JP-A. No. 6-255276 are preferably used as the reaction hardened type resin.

Such the interlayer may be provided between the support and the image receiving layer.

The image receiving layer may be subjected to a matting and/or glossiness controlling treatment by the method described in JP-A. No. 4-241993.

A transparent heat absorbing substance may be contained in the image receiving layer and/or a layer adjacent to that. Heat accumulated near the heat absorbing substance expands the image receiving layer and the dye is effectively transferred into the image receiving layer.

Various kinds of near-infrared absorbing dye are used as the heat absorbing substance. For example, a nitroso compound and its metal complex, a polymethine dye, a squalilium dye, a thiol nickel salt, a phthalocyanine dye, triallylmethane dye, an immonium dye, a diimmonium dye, a naphthoquinone dye and an anthraquinone dye are usable. Moreover, various transparent heat accumulating substance, such as a chain-shaped hydrocarbon compound such as paraffin wax, an aromatic hydrocarbon such as paraxylene, a phenol, a carboxylic acid such as stearic acid, an inclusion type haydrate compound such as $C_4H_8.117H_2O$, an alcohol, a high molecular substance having a low glass transition point such as polyethylene, are also usable. Moreover, a photoreactive heat accumulation substance utilizing a photo-isomerizing reaction heat is usable.

In the present invention, the ink sheet is fundamentally composed of a support and an ink sheet provided thereon. The ink sheet comprises at least a dye-containing region containing thermally transferable post chelate dye and a region containing substantially no dye. The "region containing no dye" means that the region does not contain a dye of which quantity and/or quality does not degrade the image quality formed by thermal transfer.

As the support for the ink sheet, material which exhibits good dimensional stability and withstands heat at recording with a heat-sensitive head can be employed.

The ink layer at the dye-containing region is composed of at least a thermally transferable post chelate dye and a binder, and the ink layer at the metal source-containing region is composed of at least a metal source and a binder.

As the binder of the ink layer, there can be illustrated, for example, cellulose series resins such as a cellulose addition compound, cellulose ester, cellulose ether, etc., polyvinyl acetal resins such as polyvinyl alcohol, polyvinyl formal, polyvinyl acetoacetal, polyvinyl butyral, etc., vinyl series resins such as polyvinylpyrrolidone, polyvinyl acetate, polyacrylamide, styrene series resins, poly(meta)acrylic acid series esters, poly(meta)acrylic acid, (meta)acrylic acid copolymer, rubber series resins, ionomer resins, olefin series resins, polyester resins, etc. Of these resins, the polyvinyl butyral, polyvinyl acetoacetal or cellulose series resins having excellent preservation quality are preferred.

As the binder of the ink layer, resins mentioned below can be employed. In Japanese Patent Publication (JP-B) No. 5-78437 there are illustrated reaction products of isocyanates with compounds having an active hydrogen selected from polyvinyl butyral, polyvinyl formal, polyesterpolyol and acrylpolyol, the above-mentioned reaction products in which isocyanates are diisocyanates or triisocyanates and the above-mentioned reaction products of 10 to 200 weight parts for 100 weight parts of the active hydrogen-containing compound; organic solvent-soluble high polymer in which intramolecular hydroxide groups in a natural and/or semi-synthesized water-soluble high polymer are esterified and/or urethanized, the natural and/or semi-synthesized water-soluble high polymers; cellulose acetates having a degree of acetylation of 2.4 or more and degree of total replacement of 2.7 or more which are described in JP-B 3-264393; vinyl resins such as polyvinyl alcohol (Tg=85° C.), polyvinyl acetate (Tg=32° C.), vinyl chloride/vinyl acetate copolymer (Tg=77° C.), etc. polyvinyl acetal series resins such as polyvinyl butyral (Tg=84° C.), polyvinyl acetoacetal (Tg=110° C.), etc., vinyl series resins such as polyacrylamide (Tg=165° C.), polyester resins such as aliphatic polyester (Tg=130° C.), etc. and the like; reaction products of isocyanates with polyvinyl butyral in which the weight of contained part of the vinyl alcohol is from 15 to 40 percent, described in JP-A No. 7-52564, the above-mentioned reaction products in which the above-mentioned isocyanates are duisocyanates or truisocyanates; phenylisocyanate-modified polyvinyl acetal resins of the formula I described in JP-A No. 7-32742; compounds obtained by hardening compositions consisting of one of isocyanate reactive cellulose or isocyanate reactive acetal resin, and one resin selected from isocyanate reactive acetal resin, isocyanate reactive vinyl resin, isocyanate reactive acrylic resin, isocyanate reactive phenoxy resin and isocyanate reactive styrol resin, and a polyisocyanate compound, described in JP-A No. 6-155935; polyvinyl butyral resins (having preferably molecular weight of 60,000 or more, glass transition temperature of 60° C. or higher, more preferably 70° C. or higher and 110° C. or lower, weight percent of vinyl alcohol part of 10 to 40 percent of polyvinyl butyral resin, preferably from 15 to 30 percent); acryl-modified cellulose series resins, as the cellulose series resins, cellulose series resins (preferably ethylcellulose) such as ethylcellulose, hydroxyethylcellulose, ethylhydroxycellulose, hydroxypropylcellulose, methylcellulose, cellulose acetate, cellulose butyrate, etc.

The above-mentioned various binders are employed individually or in combination of two or more thereof.

The dye-containing region can be one which contains two or more of dyes different in hue. For example, embodiments are enumerated in that the dye-containing region is composed of an yellow dye-containing region, a magenta dye-containing region and a cyan dye-containing region, and a region containing no dye is arranged next these dye-containing regions; the dye-containing region is composed of a black dye-containing layer and the a region containing no dye is formed next the above-mentioned region and the dye-containing region is composed of the yellow dye-containing region, a magenta dye-containing region, a cyan dye-containing region and a black dye-containing region and a a region containing no dye is formed next these dye-containing regions.

"Black dye" described herein includes an embodiment in which in addition to black dyes, black hue is prepared by combination of two or more of dyes other than the black dye, for example, an yellow dye, a magenta dye and a cyan dye are mixed to form black hue.

The hue of a dye prior to the chelation and after the chelation may be the same or very different. Yellow of a yellow dye, magenta of a magenta dye, cyan of a cyan dye and black of a black dye described herein mean the hue of the dye after the chelation.

An example of the arrangement of the ink layer on the ink sheet is explained below with reference to the drawing., FIG. 1 shows one example of an embodiment in which a dye-containing region is composed of a yellow dye-containing region, a magenta dye-containing region and a cyan dye-containing region and a metal source-containing source is formed next those dye-containing regions. In FIG. 1, an ink sheet 1 is provided with each of ink layers in order of an yellow dye-containing region 1Y, a magenta dye-containing region 1M and a cyan dye-containing region 1C and next those dye-containing regions, is provided a metal source-containing source 1*a* which contains no thermally transferable dye and contains a metal source and a combination of those arrangements is repeated.

Known various compounds are usable as the post-chelating dye without any limitation as long as the dye can thermally transfer. In concrete, cyan dyes, magenta dyes and yellow dyes described in, for example, described in JP-A. Nos. 59-78893, 59-109349, 4-94974, 4-97894 and 4-89292 are usable.

The dye containing pyrazolopyrimidine-7-on structure represented by the formula I is preferable in view of obtaining an image having high density and good storage stability among dyes mentioned above.

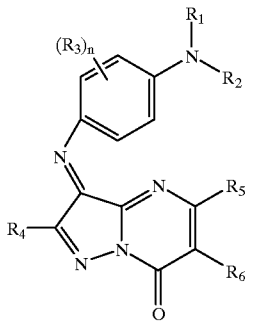

In the formula, R1 and R2 independently represent a substituted or non-substituted alkyl group, R3 represents a substituent. n is an integer of 0 to 4, R3 may be same or different when n is 2 or more. R4 is a straight chain alkyl group having two or more carbon atoms, a cycloalkyl, branched alkyl (excepting tertiary alkyl), aryl, alkoxy, aryloxy or amino group. R5 and R6 independently represent a hydrogen atom or a substituent.

In the Formula I, R4 or R5 is preferably an aryl group having a substituent at ortho position.

In the Formula I, at least one of R4, R5 and R6 is preferably a branched, but not tertiary, alkyl group.

The dye represented by Formula I is described in more detail below.

In the Formula I, the substituted or non substituted alkyl group represented by R1 and R2 is preferably a straight or branched alkyl group having 2 to 10 carbon atoms, and may be substituted by a hydroxy, alkoxy, alkoxycarbonyl group, etc. R1 and R2 may form a pyrazoline, piperidine or morpholine ring by bonding each other.

The substituent represented by R3 is not restricted to particularly as long as it is capable of substituting on benzene ring, and preferable example thereof is an alkyl, cycloalkyl, alkoxy, or acyl amino group. n represents an integer of 0 to 4, and preferably 1.

R4 is a straight chain alkyl group having two or more carbon atoms, a cycloalkyl, branched alkyl (excepting tertiary alkyl), aryl, alkoxy, aryloxy or amino group. Example of the straight chain alkyl group having two or more carbon atoms includes ethyl, ethyl, butyl, pentyl and octyl. Example of the branched alkyl includes i-propyl, i-butyl and 2-ethylhexyl. The tertiary alkyl group which is excluded from the definition of R4, is, apparent in this technical field, that having tertiary carbon atom adjacent to pyrazolopyrimidine ring, whose examples are t-butyl, t-pentyl are t-octyl, and the group having other tertiary carbon atom such as neo-pentyl, neo-hexyl and 2-t-butoxy ethyl are included.

Aryl, alkoxy, aryloxy or amino group represented by R4 is respectively the same group as described for %5 and R6.

The branched alkyl (excepting tertiary alkyl), aryl group having a substituent on ortho position such as o-chlorophenyl, o-tolyl, o-anisyl, 2,6-dichlorophenyl, o-(2-ethoxyethoxy)phenyl, o-butoxyphenyl and mesityl group are preferable among the substituents for R4.

The substituent represented by R5 and R6 includes a straight or branched chain alkyl group such as methyl, ethyl, i-propyl, t-butyl, dodecyl and 1-hexylnonyl, a cycloalkyl group such as cyclopropyl, cyclohexyl, bicyclo[2.2.1]heptyl and adamanthyl, an alkenyl group such as 2-propylene and oleyl, an aryl group such as phenyl, o-tolyl, o-anisyl, 1-naphthyl and 9-anthranil), a heterocyclic group such as 2-tetrahydrofuryl, 2-thiophenyl, 4-imidazolyl and 2-pyridyl, a halogen atom such as fluorine, chlorine and bromine, cyano group, nitro group, hydroxyl group, carbonyl group such as alkyl carbonyl group such as acetyl, trifluoroacetyl, and pivaloyl,arylcarbonyl group such as benzoyl, pentafluorobenzoyl, 3,5-di-t-butyl-4-hydroxybenzoyl, oxycarbonyl group such as alkoxycarbonyl group of methoxycarbonyl, cyclohexyl oxycarbonyl and dodecyloxy carbonyl, aryloxy carbonyl group of phenoxy carbonyl, 2,4-di-t-pentyl phenoxy carbonyl and 1- naphthyloxy carbonyl, heterocycle oxycarbonyl such as 2-pyridyl oxycarbonyl and 1-phenyl pyrazolyl-,-oxycarbonyl), carbamoyl group such as alkylcarbaenoyl of diethylcarbamoyl and 4-(2,4-di-t-pentyphenoxy) butylaminocarbamoyl, aryloxycarbamoyl of phenylcarbamnoyl and 1-naphtylcarbamoyl, alkoxy group such as methoxy and 2-ethoxyethoxy), aryloxy group such as phenoxy and 2,4-di-t-pentyl phenoxy, heterocycle oxy group such as 4-pyridyl hydroxy and 2-hexahydropyranyl hydroxy, carbonyl oxy group such as alkylcarbonyloxy group of acetyloxy trifluoroacetyloxy and pivaloyloxy, aryloxy group of benzoyloxy and pentafluorobenzoyloxy, urethane group such as alkyl urethane group of N,N-dimethyl urethane and arylurethane such as N-phenyl urethane, N-(p-cyanophenylurethane, sulfonyloxy group such as alkylsulfonyl oxy group of methanesulphonyloxy, trifluorousethane sulfonylhydroxy, dodecanesulfonyloxy and arylsulfonyloxy group of benzenesulfonyloxy, p-toluenesulfonyloxy, amino group such as alkylamino group of n-dodecyl amino, dimethylamino and cyclohexyl amino, arylamino group of anilino, p-t-octyl anilino), sulfonylamino group such as alkylsulfonylamino group of hexadecylsulfonylamino, methanesulphonylamino and heptafluoropropanesulfonyl amino, arylsulfonylamino group of p-toluenesulfonyl amino, and pentafluorobenzenesulfonyl amino, sulfamoyl amino group such as alkylsulfamoyl amino group of N,N-dimethylsulfamoylamino, and arylsulfamoyl amino group of N-phenylsulfamoyl amino), acylamino-group such as alkylsulfamoyl amino group of N,N-dimethylsulfamoyl amino, and arylsulfamoyl group of N-phenylsulfamoylamino, acylamino group such as alkylcarbonylamino group of acetylamino and myristoylamino, arylcarbonylamino group of benzoylamino, ureide group such as alkyl ureide group of N,N-dimethylamino ureide and arylureide of N-phenylureide, N-p-cyanophenylureide, sulfonyl group such as alkylsulfonyl group of methanesulfonyl and trifluoromethane sulfonyl, and arylsulfonyl group of p-toluenesulfonyl), sulfamoyl group such as alkylsulfamoyl of dimethyl sulfamoyl, 4-(2,4-di-t-amylphenoxy) butylaminosulfonyl, and arylsufamoyl of phenysulfamoyl, alkylthio group such as methylthio and t-octylthios arylthio group such as phenylthio, and heterocycle thio group such as 1-phenyltetrazole-5-thio, 5-methyl-1,3,4-oxadiazole-2-thio are listed.

Among the substituents cited above, alkyl, aryl and acylamino group are preferable for R5 and R6. It is also preferable those forming non-aromatic ring structure such as cyclopentene, cyclohekyn, cycloheptene etc. by R5 and R6.

Practical examples of the dye represented by Formula (I) below.

1

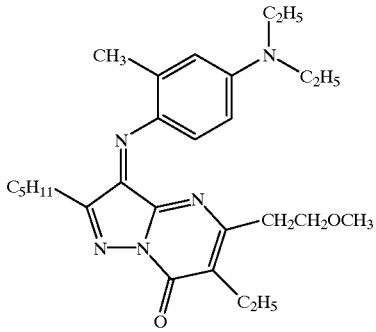

2

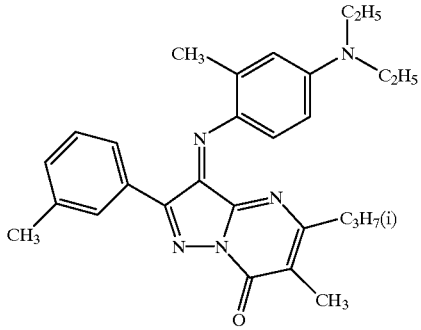

3

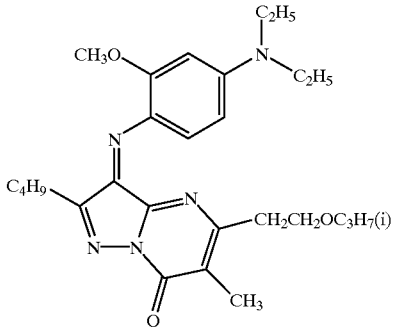

4

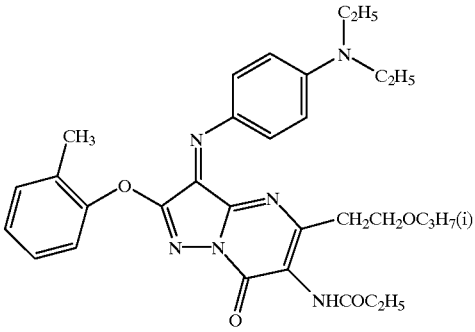

-continued

5

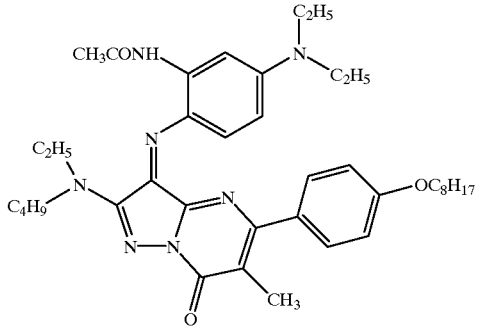

6

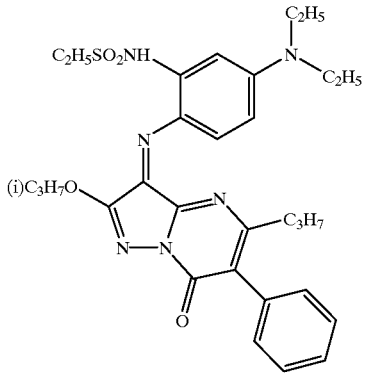

7

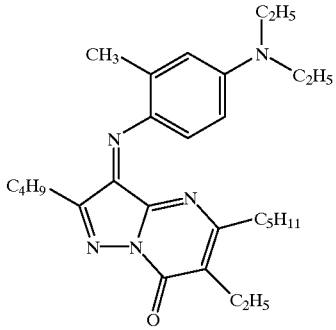

8

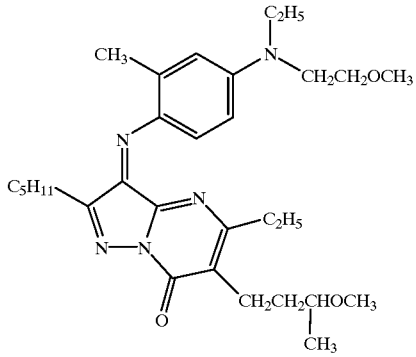

-continued
9
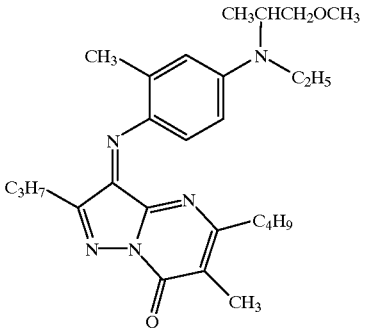
10
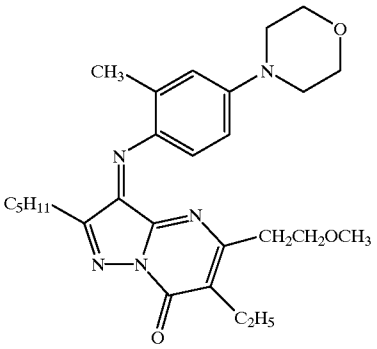
11
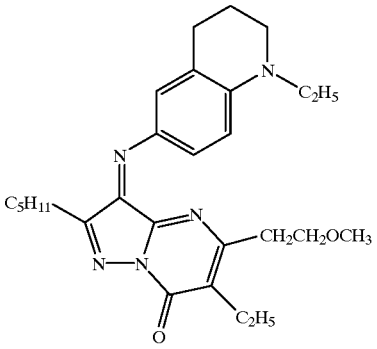
12
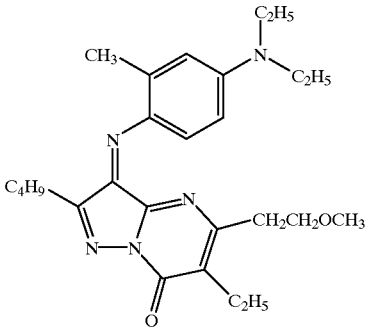
-continued
13
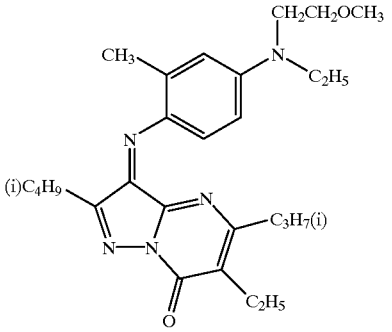
14
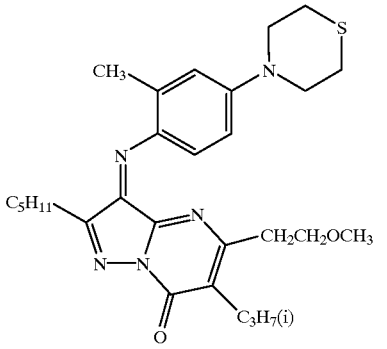
15
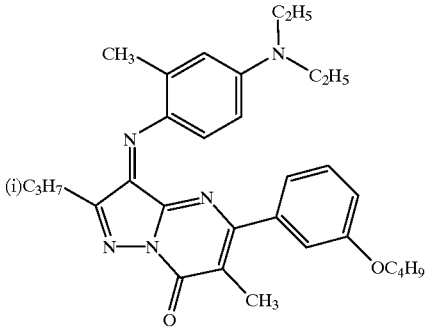
16
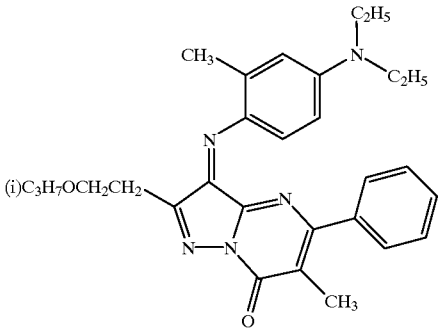

-continued
17
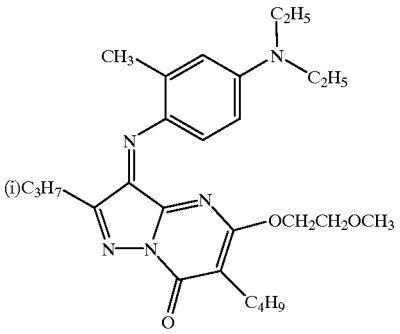
18
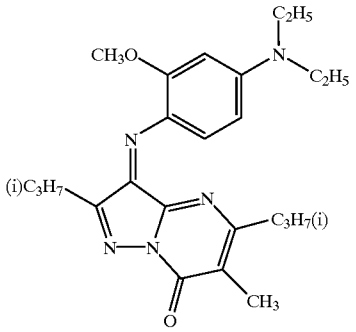
19
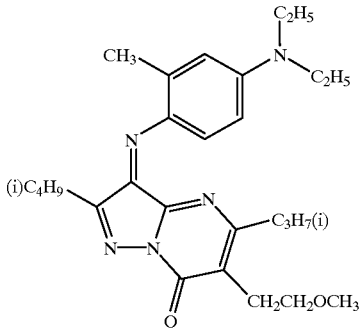
20
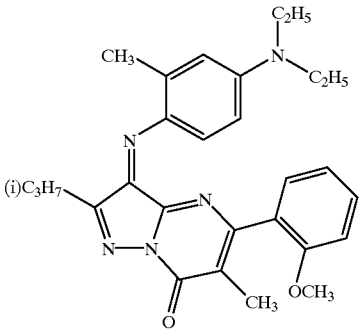
-continued
21
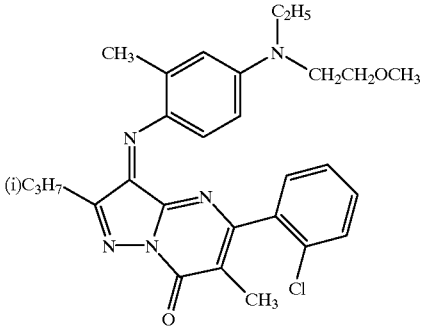
22
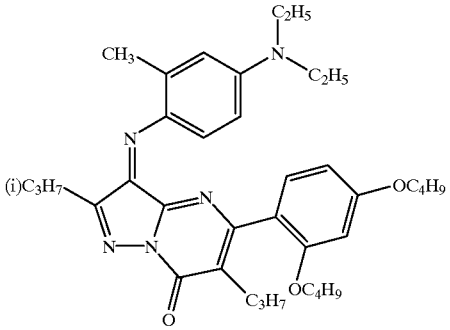
23
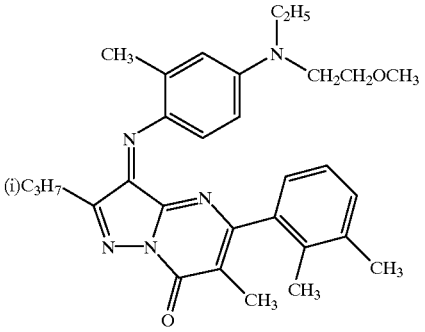
24
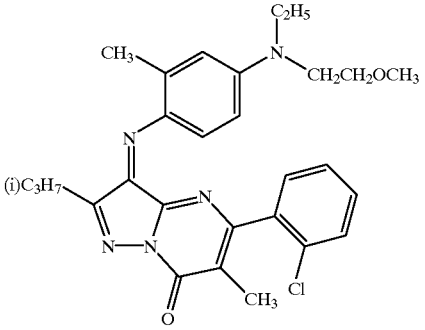

25
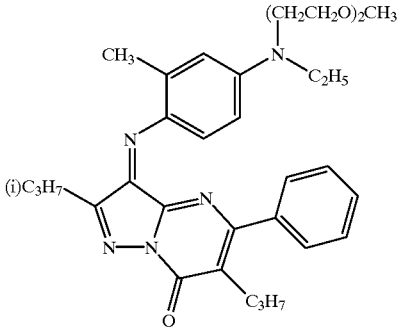
26
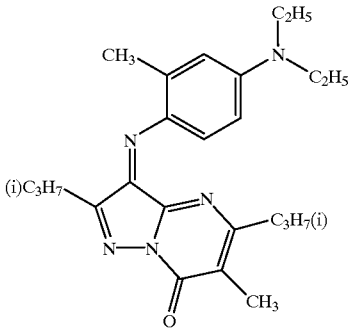
27
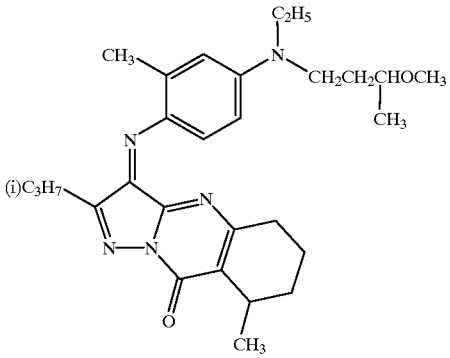
28
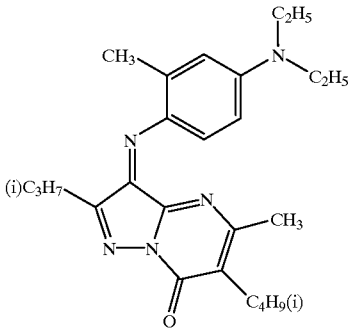
29
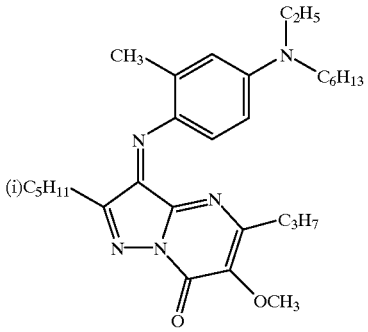
30
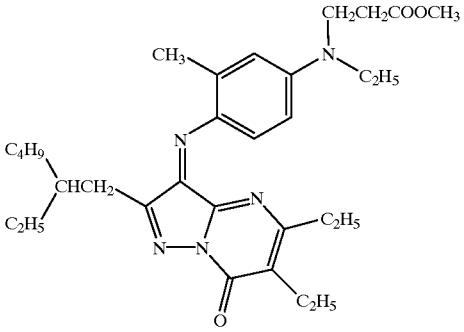
31
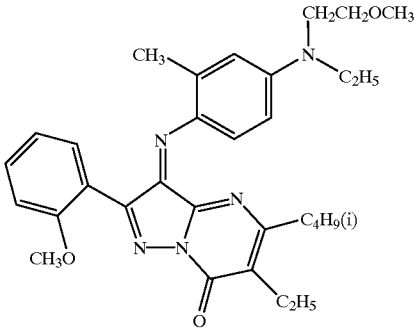
32
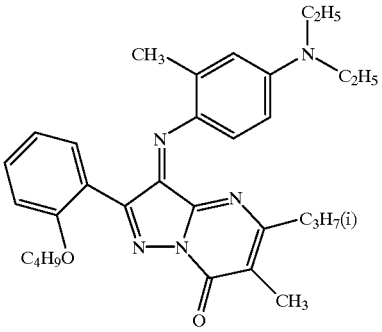

-continued
33
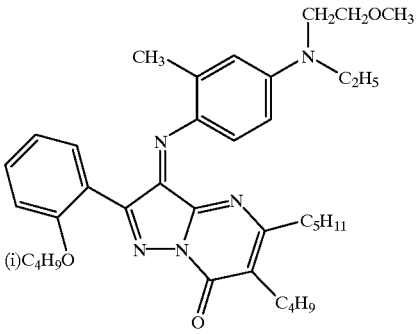
34
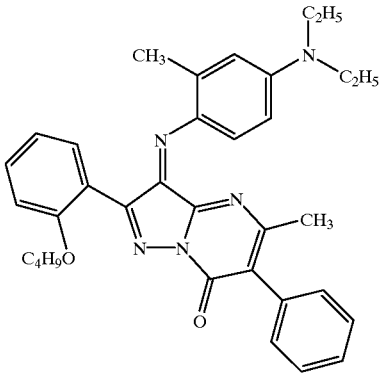
35
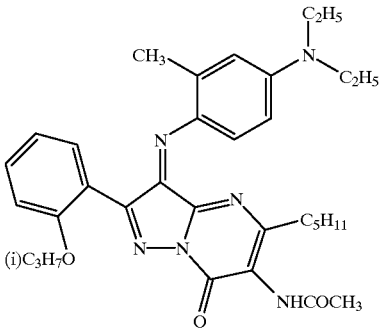
36
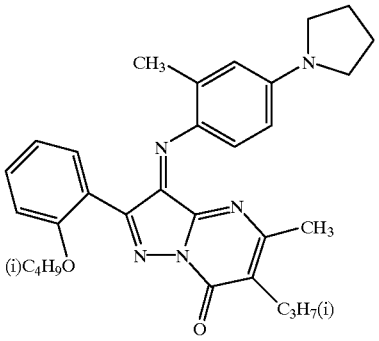
-continued
37
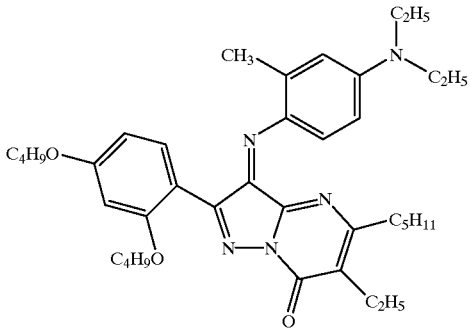
38
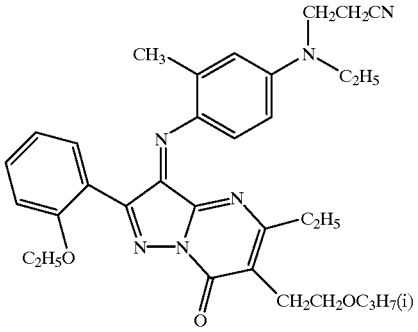
39
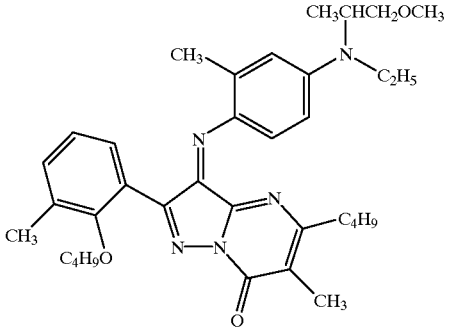
40
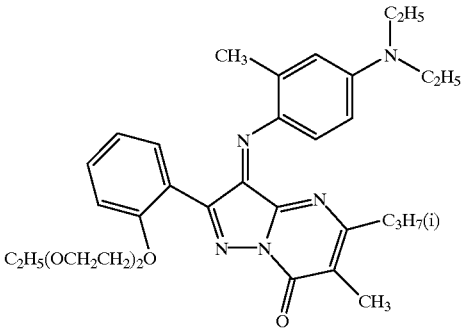

41
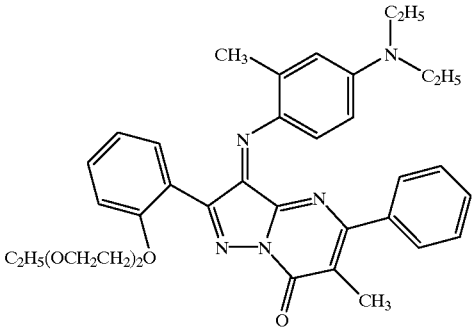
42
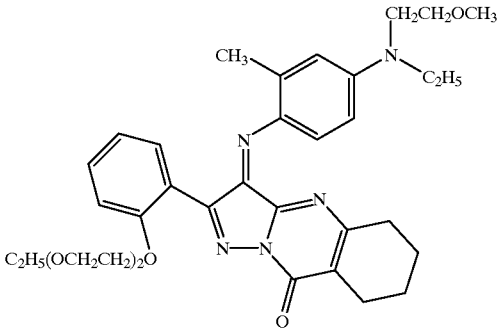
43
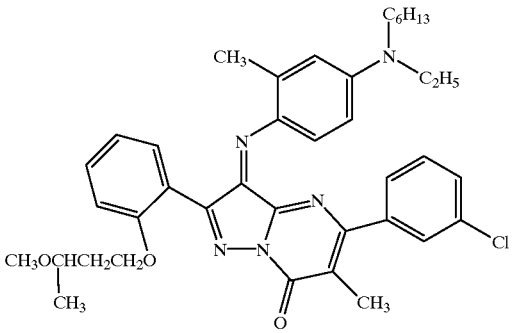
44
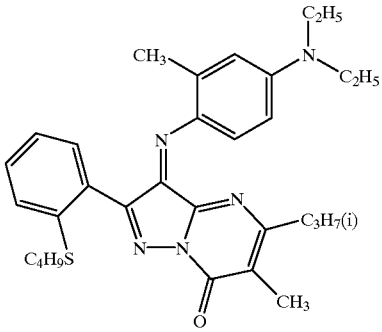
45
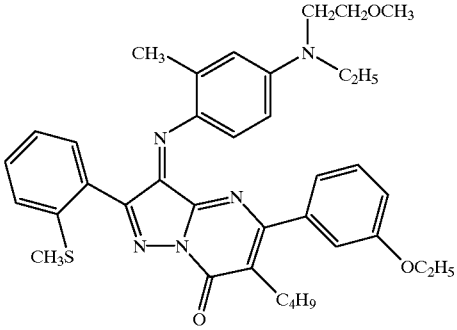
46
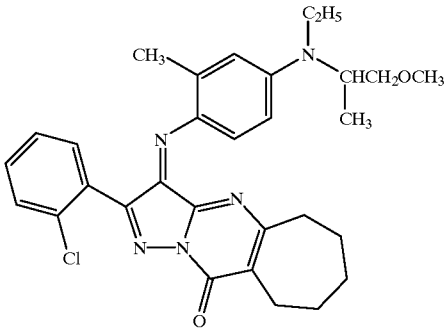
47
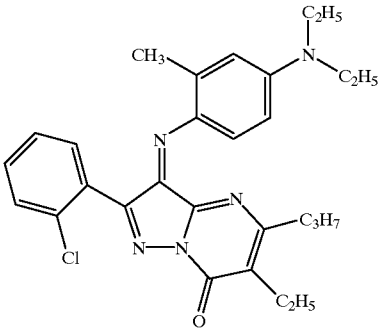
48
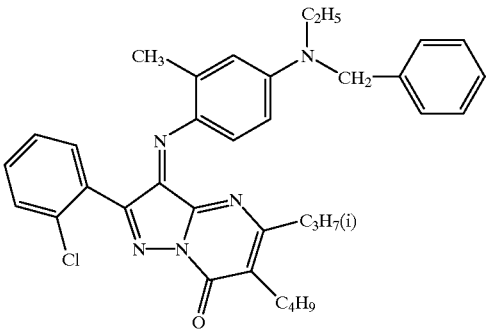

-continued
49
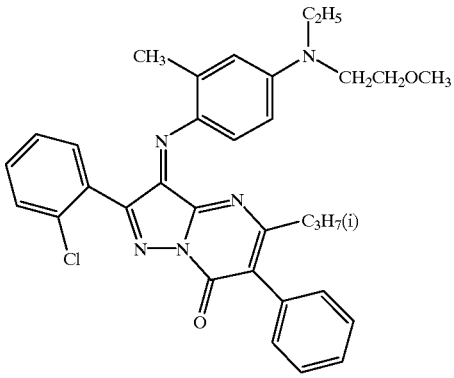
50
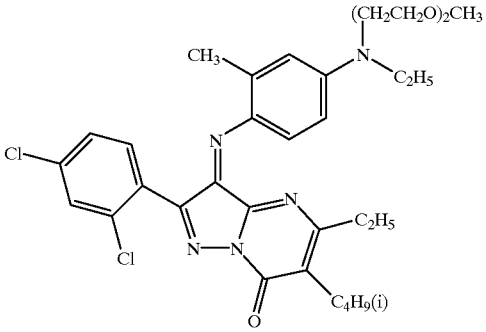
51
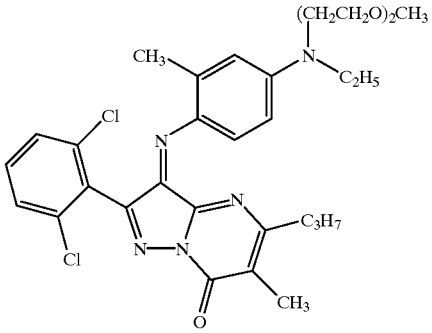
52
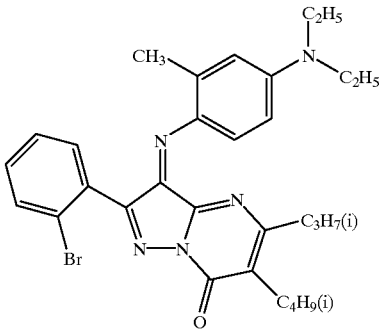
-continued
53
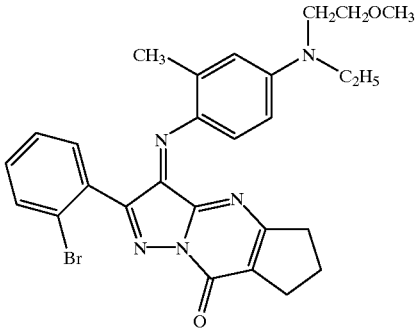
54
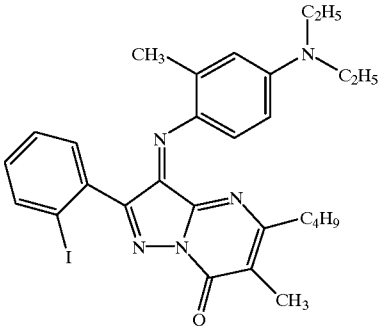
55
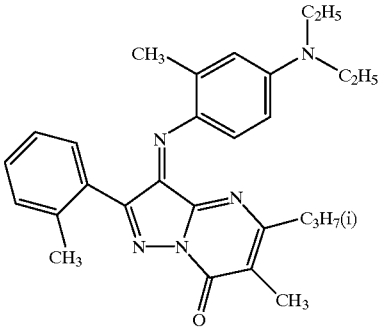
56
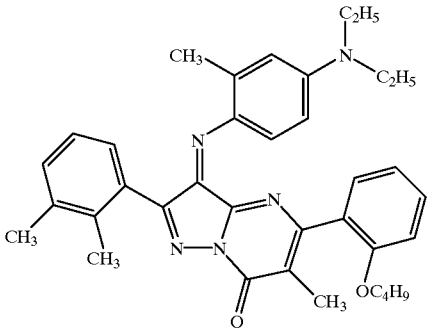

-continued

57

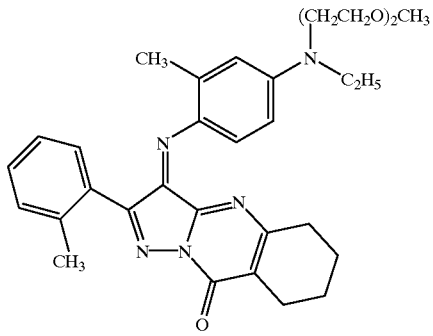

58

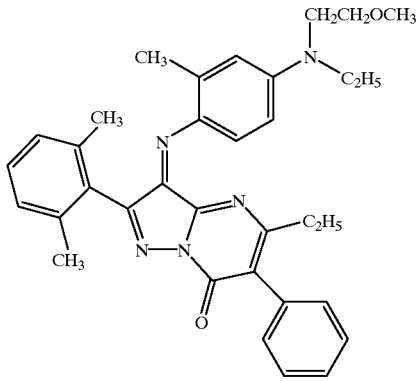

59

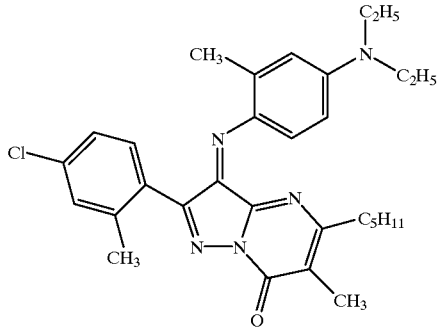

60

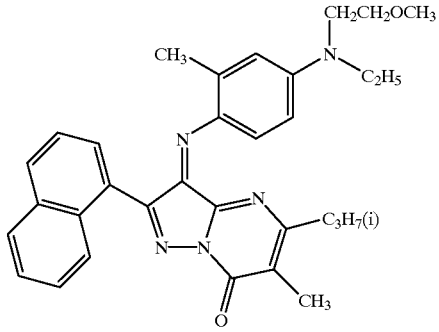

The dye containing pyrazolopyrimidine-7-on structure described above can be synthesized , for example, by the following way.

Synthesis Example (Synthesis of Exemplified Compound 55)

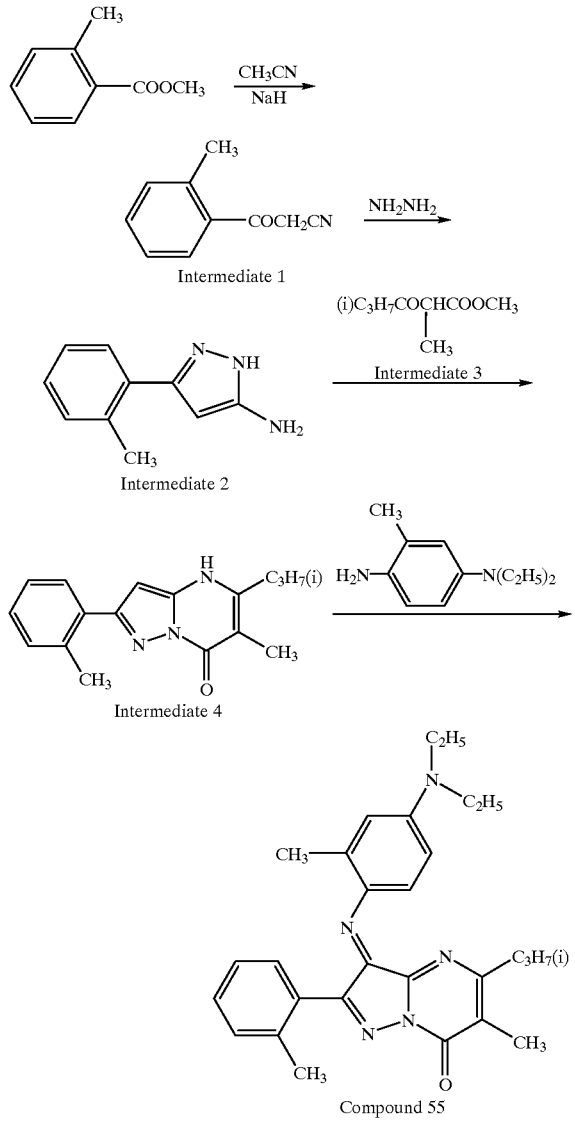

Synthesis of Intermediate 1

Sodium hydride in an amount of 126 g (60 weight %) is suspended in toluene 1100 ml, and mixture of 273 g of o-methyl toluylate and 140 g of acetonitrile is dripped into it at room temperature there. After end of the drip, it is stirred for ten hours with heating at 60° C. Reaction product is cooled in room temperature, and is poured into water, acetic acid is added to neutralize and is extracted with ethyl acetate. Organic phase is washed repeatedly by water, and residue obtained by removing solvent by evaporation under reduced pressure is recrystallized with i-propanol. Crystal of intermediate 1 in amount of 299 g is obtained. The structure was confirmed with NMR spectrum and mass spectrum.

Synthesis of Intermediate 2

The intermediate 1, in an amount of 288 g, is dissolved in 1900 ml of ethanol, 100 g of hydrazine monohydrate is added to it, and it is refluxed with heating for 12 hours. Reaction product is cooled in room temperature, and is poured into water, and is extracted with ethyl acetate.

Organic phase is washed repeatedly by water, and solvent is removed by evaporation under reduced pressure. Pale brown oil of intermediate 2 in amount of 300 g is obtained. It is employed in the next reaction process without further purification.

Synthesis of Intermediate 4

In 450 ml of butanol 60.4 g of intermediate 2 and 73.7 g of intermediate 3 are dissolved, and p-toluenesulfonic acid of catalyst quantity was added, and it is refluxed with heating for 25 hours. Reaction product is cooled in room temperature, and is poured into water, and is extracted with ethyl acetate. Organic phase is washed repeatedly by water. The solvent is removed by evaporation under reduced pressure, the residue thus obtained is recrystallized with acetonitrile. Crystal of intermediate 4 in amount of 78.1 g is obtained. The structure was confirmed with NMR spectrum and mass spectrum.

Synthesis of Exemplified Compound 55

In 75 ml of ethyl acetate 2.50 g of intermediate 4 is dissolved, and 100 ml of 5% aqueous solution of potassium carbonate and 2.09 g of 4-(N,N-diethylamino)aniline chloride are added and aqueous solution containing 6.08 g of ammonium persulfate is dripped. After end of the drip, organic phase is washed repeatedly by water, and residue obtained by removing solvent by evaporation under reduced pressure is recrystallized with acetonitrile. Crystal of exemplified compound 55 in amount of 3.10 g is obtained. The structure was confirmed with NMR spectrum and mass spectrum.

The dye is usually used in an amount of from 10% to 80% by weight of the whole compositions contained in each of the area containing the dye, even though the content of the dye may vary depending on the property of the dye, the solubility of the dye in the binder or the purpose of use.

As a metal source to be contained in the metal source containing area of the ink sheet, the compound described as the metal source to be contained in the image receiving layer mentioned above. Quantity of metal source in the metal source containing area of the ink sheet is, 1 to 100 weight %, preferably 10 to 50 weight % of binder amount in case that the image receiving layer contains metal source, and 10 to 250 weight %, preferably 50 to 150 weight % of binder amount in case that the image receiving layer does not contain metal source. It is not preferable as the image is spoiled caused by that post chelate dye is adsorbed to the metal source transfer layer during the storage in a roll state when the metal source in the ink sheet is in excess.

Various kinds of additive other than the above-mentioned may be optionally further added to the ink layer. The additives include the foregoing mold releasing agent such as a silicone compound including reaction hardenable type, a silicone-modified resin, a fluorized resin, a surfactant and a wax, a filler such as a fine metal powder, a silica gel, a metal oxide, carbon black, and a resin powder, a hardening agent capable of reacting with the binder, for example, a irradiation reactive compound such as an isocyanate compound, an acryl compound and an epoxy compound.

Another layer may be further provided on the support of the ink sheet. For example, an over-coat layer may be provided on the surface of the ink layer to prevent adhesion or blocking with the image receiving layer caused by fusion and transfer of dye to the back side of another sheet.

A subbing layer may be provided on the support of the ink sheet for improving an adhesion ability of the support to the ink layer and for preventing transfer of the dye precursor to the support. Furthermore, an anti-sticking layer may be provided on the back side, opposite to the ink layer provided side, for preventing fusion adhesion and sticking of the thermal head to the support and formation of a wrinkle of the support. The thickness of the over-coat layer, the subbing layer and the anti-sticking layer are each ordinary from 0.1 $\mu$m to 1 $\mu$m.

The ink sheet can be manufactured in such a way that an ink layer-preparing coating liquid is prepared by dissolving or dispersing the above-mentioned various compositions composing an ink layer to a solvent and the resulting is coated on the surface of a support for the ink sheet employing, for example, a gravure printing process and dried. The thickness of the formed ink layer is generally in the range of from 0.2 to 10 $\mu$m and preferably in the range of from 0.3 to 3 $\mu$m.

An anti-static function may be given to the image receiving sheet and/or the ink sheet. Known technology can be applied to give the anti-static function. Namely, known electric conductive substances such as a fine powder of metal, metal oxide and carbon, organic compounds so called antistatic agent such as an anionic, cationic, amphoteric and nonionic surfactant and a polysiloxane compound, fine powder of electron inorganic conductive substances such as a fine powder of titanium oxide, zinc oxide, tin oxide or indium oxide subjected to a doping treatment in which the powder is mixed with an impurity and baking to introduce an irregularly into the crystal lattice for raising the electron conductivity are usable. The foregoing electric conductive substances may be added into at least one of the layers of the image receiving sheet and/or the ink sheet, or a layer containing the electric conductive substance may be provided. Of course, a combination of the above-mentioned layers is preferably used.

The resin to be the binder of the electric conductive layer is preferably a thermally hardenable resin such as a thermally hardenable polyacrylate resin and a polyurethane resin, or a thermoplastic resin such as a poly(vinyl chloride) resin, a polyvinylbutyral resin and a polyester resin. The ratio of the binder to the electro conductive substance is preferably decided so that the surface intrinsic resistance of the electric conductive layer after coating and drying or hardening is not more than $1\times10^{10}$ $\Omega$.cm.

The electric conductive liquid thus prepared can be coated by an ordinary coating method such as coating by a blade coater or a gravure coater, and a spray coating method.

When the electric conductive layer is provided on the support to give the anti-static function, it is preferred to coat an aqueous solution of the anti-static agent on the support or the electron conductive inorganic fine powder dispersed in a synthesized resin emulsion, a synthesized rubber latex or an aqueous solution of a water-soluble resin on the support and to dry the coated layer. An emulsion of a polyacrylate resin or that of a urethane resin is usable as the synthesized resin emulsion, and a latex of methyl methacrylate-butadiene rubber or that of atyrene-butadien rubber is usable as the synthesized rubber latex. An aqueous solution of polyvinyl alcohol) resin, polyacrylamide resin or starch are usable as the aqueous solution of water-soluble resin. The electric conductive layer may be formed more simply by spraying an aqueous solution of the anti-static agent.

In another embodiment, an anti-static layer composed of an acryl resin and an epoxy resin described in JP-A. No. 8-52945 may be used for rising the adhesiveness, when an anti-static layer is provided on the support of the image receiving sheet or the ink sheet.

Such the anti-static layer can be formed by coating and drying a coating liquid which contains the foregoing principal agent and a hardening agent in a suitable ratio, on at least one of the surface of the core material or support of the image receiving sheet or the ink sheet, or on a primer layer or a adhesive layer provided on the surface of the material of the support. The anti-static layer may be provided either on the surface of the core material or the support on which the ink layer or the image receiving layer is provided, or on the surface opposite to the surface on which the ink layer or the image receiving layer is provided. In the former case, the image receiving layer or the ink layer is provided on the antistatic layer. Moreover, another layer such as a heat resistive slippery layer or a back surface slippery layer may be provided on the anti-static layer. An ordinary method can be applied for providing such the layer.

When the anti-static agent is added into the image receiving layer, the anti-static agent is soluble in an organic solvent. Examples of the organic solvent-soluble anti-static agent are described, for example, in JP-A. No. 5-64979.

The above-mentioned anti-static agent is preferably added into the image receiving layer in an amount of from 0.1 to 10 parts by weight per 100 parts by weight of the resin forming the image receiving layer. The anti-static effect become insufficient when the used amount is too low, and the dye acceptability the image receiving layer and the storage ability of formed image tend to degraded when the amount is excessive. It is preferable that the anti-static agent is distributed in the thick-direction of the image receiving layer so that not more than 50% by weight of the anti-static agent is contained within ⅕ of the thickness of the layer at the outer surface side. When the layer has such the structure, a good antistatic property can be stably maintained even when plural dye images are transferred on the same area of the image receiving sheet. It is preferable to form such the structure that the drying rate of the image receiving layer is set as slow as possible so that the anti-static agent having a molecular weight lower than that of the binder resin is distributed with a higher dense at the surface side of the image receiving layer.

The ink layer of the present invention may incorporate a low molecular substance having a melting point of 50 to 150° C. as a sensitizer. The sensitizer having the melting point of lower than 50° C. is not preferred because it tends to move to the surface of the ink layer and on the other hand, the sensitizer having the melting point of higher than 150° C. is not preferred because the sensitizing action decreases sharply.

Furthermore, the molecular weight of the sensitizer is preferably in the range of 100 to 1,500. The sensitizer having the molecular weight of less than 100 is not preferred because its melting point is generally lower than 50° C. On the other hand, the sensitizer having the molecular weight of larger than 1,500 is also not preferred because the fusion sharpness is lost and the sensitizing action becomes insufficient.

Furthermore, the used amount of the above-mentioned sensitizer is preferably in the range of 1 to 100 parts by weight per 100 parts by weight of the binder employed to form the ink layer. The used amount of less than 1 part by weight is not preferred because no satisfactory sensitizing action is obtained. On the other hand, the used amount exceeding 100 parts by weight is not preferred because the thermal resistance of the ink layer decreases.

As sensitizers such as mentioned above, those having a low molecular weight are available as far as those have a melting point of 50 to 150° C. However, as those preferred, there are illustrated thermoplastic oligomers, for example, various kinds of oligomers such as polyurethane oligomer, polystyrene oligomer, polyester oligomer, polyacryl oligomer, polyethylene oligomer, polyvinyl chloride oligomer, polyvinyl acetate oligomer, ethylene/vinyl acetate copolymer oligomer, ethyleneacryl copolymer oligomer, polyoxyethylene oligomer, polyoxypropylene oligomer, polyoxyethylenepropylene oligomer, etc., fatty acids such as myristic acid, palmitic acid, margaric acid, stearic acid, arachic acid, montanic acid, etc., fatty acid amides such as caproic acid amide, caprylic acid amide, lauric acid amide, stearic acid amide, oleic acid amide, eicosanic acid amide, etc., fatty acid esters such as methyl behenate, pentadecyl palmitate, hexacocyl stearate, [1,4-phenylenebis (methylene)]bisdimethyl carbamate, etc., and aromatic compounds such as 1,4-dicyclohexylbenzene, benzoic acid, aminobenzophenone, dimetylterephthalate, fuluorantene, phenols, naphthalenes, phenoxys, various waxes, etc.

A conventional heating apparatus such as thermal head, a heat roller, a thermal press employing metal plate or heat-resist silicone rubber, hot stamping etc. are employed as the heating apparatus employed for transferring the dye and the metal source in the ink layer of the ink sheet to the image receiving layer of the image receiving sheet.

The thermal head and heat roller are preferably employed in view of size of the apparatus and compactness.

Figure 2:
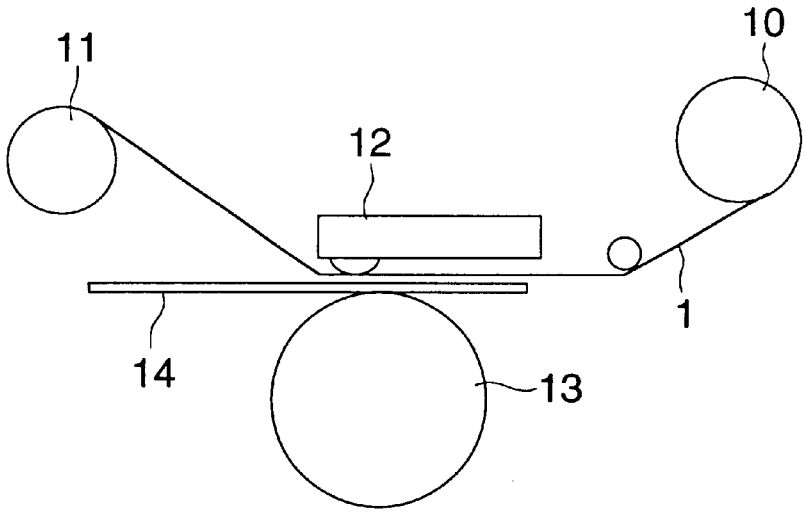
FIG. 2 shows a schematic view of a thermally transfer recording apparatus employed in the present invention.

An apparatus illustrated in FIG. 1 may be employed, for example, as the thermal transfer recording apparatus. In FIG. 2, numeral 10 denotes ink sheet supplying roll, 1 is an ink sheet, 11 is a taking roll to wind up the used sheet 1, 12 is a thermal head, 13 is a platen roller, and 14 is an image receiving sheet interposed between the thermal head and platen roller.

To form a transfer image by employing the thermal transfer recording apparatus illustrated in FIG. 2, and an ink sheet, for example, as illustrated in FIG. 1, yellow dye containing area Y1 of the ink sheet 1 and image receiving layer of the image receiving sheet are superposed, and the yellow dye is transferred to image receiving sheet according to the image data by heating with thermal head to form yellow dye image at first, next magenta dye is similarly transferred imagewise from the magenta dye containing area M1 on the yellow image, then cyan dye is similarly transferred from the cyan dye containing area imagewise on the transferred image, at last, necessary substances are transferred from the area containing no dye the whole area of the image whereby the image forming is completed.

EXAMPLES

Examples of the invention is described below.

Example 1

<Preparation of Ink Sheet 1>

On the back surface of the thermal resistive layer of a poly(ethylene terephthalate) film K-203E-6F, manufactured by Diafoil-Hoechst Co., Ltd., 6 μm thickness, having a thermal resistive layer, a yellow, magenta and cyan ink layer forming composition and a metal source containing (but no dye containing) layer forming composition were coated by a gravure coating method so that each of the frame of the layers were sequentially positioned as shown in FIG. 1*a*, wherein thickness of each layer was 1 μm in dried state. The composition of each layer was shown below.

| | |
|---|---|
| Post-chelating dye: Exemplified compound (d) | 3 parts |
| Polyvinylbutyral (KY-24, manufactured by DENKI KAGAKU KOGYO K. K.) | 5.5 parts |

-continued

| | |
|---|---|
| Urethane-modified silicone Resin (Diaroma SP-2105, manufactured by DAINICHISEIKA COLOR & CHEMICAL Mfg. Co., Ltd.) | 1.5 parts |
| Methylethylketone | 80 parts |
| Cyclohexanone | 10 parts |
| Magenta ink layer | |
| Post-chelating dye: Exemplified compound (a) | 3.0 parts |
| Polyvinylbutyral (KY-24, manufactured by DENKI KAGAKU KOGYO K. K.) | 5.5 parts |
| Urethane-modified silicone Resin (Diaroma SP-2105, manufactured by DAINICHISEIKA COLOR & CHEMICAL Mfg. Co., Ltd.) | 1.5 parts |
| Methylethylketone | 80 parts |
| Cyclohexanone | 1 parts |
| Yellow layer forming composition | |
| Post-chelating dye: Exemplified compound (b) | 1 parts |
| Polyvinylbutyral (KY-24, manufactured by DENKI KAGAKU KOGYO K. K.) | 5.5 parts |
| Urethane-modified silicone Resin (Diaroma SP-2105, manufactured by DAINICHISEIKA COLOR & CHEMICAL Mfg. Co., Ltd.) | 1.5 parts |
| Methylethylketone | 80 parts |
| Cyclohexanone | 10 parts |
| Metal Source Containing Layer Coating Composition | |
| Polyvinylbutyral (KY-24, manufactured by DENKI KAGAKU KOGYO K. K.) | 5.5 parts |
| Metal ion compound | 0.01 parts |
| Urethane-modified silicone Resin (Diaroma SP-2105, manufactured by DAINICHISEIKA COLOR & CHEMICAL Mfg. Co., Ltd.) | 1.5 parts |
| Methylethylketone | 80 parts |
| Cyclohexanone | 10 parts |
| Preparation of Image-receiving Sheet 1 | |

On a 200 μm synthetic paper support (YUPO FPG #200, manufactured by Oji Yuka), which was treated with corona discharge processing on one side, an subbing layer-forming coating composition having the following compositions was coated with a wire bar coating method on the subbing layer and dried to form an subbing layer having a thickness of 0.2 μm.

Subbing Layer Coating Composition 1

| | |
|---|---|
| Styrene-acrylonitrile (Rytac A200PC, manufactured by Mitsui Chemical, Co., Ltd.) | 0.96 parts |
| Epoxy modified acrylic resin (GP-301, manufactured by TOA GOSEI Co., Ltd.) | 0.24 parts |
| Isocyanate (Coronate HX manufactured by Nippon Polyurethane Kogyo Co., Ltd.) | 0.8 parts |
| Methylethylketone | 88.2 parts |
| n-Butyl acetate | 9.8 parts |

Subsequently, after preparation of an image receiving layer coating composition (hereafter referred to coating composition) mentioned below, it was coated by wire-bar and dried to form an image receiving layer having 4 μm thickness, and a thermally transfer image receiving material was obtained.

Image Receiving Layer Coating Composition 1

| | |
|---|---|
| Styrene-acrylonitrile (Rytac A200PC, manufactured by Mitsui Chemical, Co., Ltd.) | 8.5 parts |
| Metal ion containing compound exemplified compound MS-1 | 1.5 parts |
| Post-chelating dye: (c) | 0.005 parts |

-continued

| | |
|---|---|
| Post-chelating dye: (d) | 0.005 parts |
| Methylethylketone | 80 parts |
| n-Butyl acetate | 10 parts |

The coating composition was coated and dried and the image receiving sheet 1 was prepared.

The post-chelating dyes (a) to (d) are as follows.

(a)

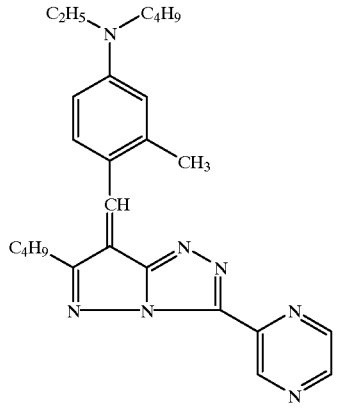

(b)

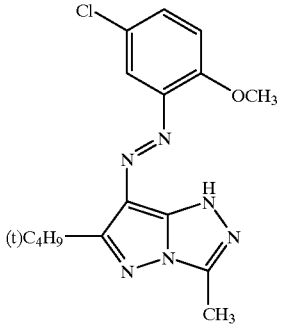

(c)

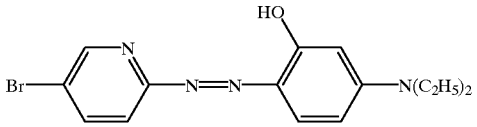

(d)

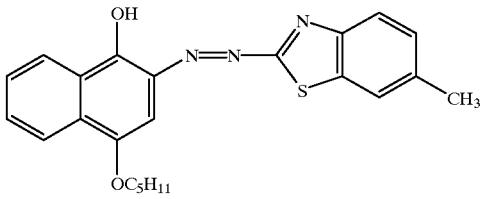

Preparation of Image Receiving Sheet 2

The first layer, the second layer and the third layer described below were simultaneously extruded on stainless steel belt by an extrusion machine at 300° C. to form a 3-layer sheet as the porous PET sheet A. The film was stretched three times for conveying direction while it was conveyed by means of heated roll at 115° C. Then the film was stretched for rectangular to the conveying direction while it was brought by clips on both sides. Subsequently it was subjected to thermal fix at 200° C., and cooled slowly to room temperature and the film having specific gravity of 0.7 μm, composed of the first layer of thickness 8 μm, the second layer 35 μm and the third layer 8 μm.

| | |
|---|---|
| PET | 90 parts |
| PET-PTMG (prepared by adding polytetramethyleneglycol, (PTMG) molecular weight of 4,000 during the synthesizing of PET so as to the ratio of 1:1 by weight) | 1 parts |
| Syndioctatic styrene (Salec S10, manufactured by Idemitsu Petroleum Co., Ltd.) | 6 parts |

Thus prepared PET sheet was subjected to corona discharge treatment on one side, and the following subbing layer forming composition was coated by wire bar coating method on the discharged side and dried to form a subbing layer of 0.2 μm thickness.

Subbing Layer Forming Composition 2

| | |
|---|---|
| Styrene-acrylonitrile (Rytac A200PC, manufactured by Mitsui Chemical, Co., Ltd.) | 0.96 parts |
| Epoxy modified acrylic resin (GP-301, manufactured by TOA GOSEI Co., Ltd.) | 0.24 parts |
| Isocyanate (Coronate HX manufactured by Nippon Polyurethane Kogyo Co., Ltd.) | 0.8 parts |
| Methylethylketone | 88.2 parts |
| n-Butyl acetate | 9.8 parts |

Subsequently, after preparation of an image receiving layer coating composition (hereafter referred to coating composition) mentioned below, it was coated by wire-bar and dried to form an image receiving layer having 4 μm thickness, Image Receiving Layer Coating Composition 2

| | |
|---|---|
| Styrene-acrylonitrile (Rytac A200PC, manufactured by Mitsui Chemical, Co., Ltd.) | 8.5 parts |
| Metal ion containing compound exemplified compound MS-1 | 1.5 parts |
| Post-chelating dye: (c) | 0.005 parts |
| Post-chelating dye: (d) | 0.005 parts |
| Methylethylketone | 80 parts |
| n-Butyl acetate | 10 parts |

The coating composition was coated and dried and the image receiving sheet 2 was prepared.

Preparation of Image Receiving Sheet 3

Image receiving sheet 3 was prepared in the same way and same composition as the image receiving sheet 1 except that the metal ion containing composition MS-1 was removed in the image receiving layer coating composition.

Preparation of Image Receiving Sheet 4

On a high quality paper having basis weight of 130 g/m$^2$ and thickness of 150 μm the following aqueous dispersion coating composition was coated so as to have dry weight of 20 g/m$^2$, and dried for 5 minutes at 110° C. Spray glue (99Spray glue, manufactured by 3M Co.) was sprayed to have a thickness of about 15 μm and dried on another side having the aqueous dispersion coating and the porous PET sheet A employed in the image receiving sheet 2, and they were pasted each other at the sprayed surface and affixed through a laminator at 140° C. to prepare a PET laminated sheet B.

Aqueous Dispersion Coating Composition A

| | |
|---|---|
| Saturated polyester (Binar MD1200, manufactured by TOYOBO CO., LTD.) | 100 parts |
| Silica fine particles (Mizukasolve C-1, manufactured by Mizusawa Kagaku) | 25 parts |
| Tin oxide sol (solid part content 20%) | 10 parts |
| Water | 70 parts |

Thus prepared PET sheet was subjected to corona discharge treatment on one side, and the same subbing layer forming composition and image receiving layer forming composition as the image receiving sheet 2 was coated by the same method on the discharged side and dried to obtain the image receiving sheet 4.

Preparation of Image Receiving Sheet 5

The following subbing layer forming composition was coated by wire bar coating method on the discharged side and dried to form a subbing layer of 0.2 μm thickness, by employing the porous PET sheet A used in the image receiving sheet 2 as a support.

Subbing Layer Forming Composition 5

| | |
|---|---|
| Polyvinylbutyral (Eslex BL-1, Sekisui Chemical Co., Ltd.) | 9 parts |
| Isocyanate (Coronate HX) | 1 parts |
| Methylethylketone | 80 parts |
| n-Butyl acetate | 10 parts |

Image Receiving Layer Coating Composition 5

| | |
|---|---|
| Polyvinylbutyral (KY-24, manufactured by DENKI KAGAKU KOGYO K. K.) | 6 parts |
| Metal ion containing compound exemplified compound MS-1 | 25 parts |
| Post-chelating dye: (c) | 0.005 parts |
| Post-chelating dye: (d) | 0.005 parts |
| Methylethylketone | 80 parts |
| Butyl acetate | 10 parts |

After the coating composition mentioned above was coated and dried, then the releasing layer forming composition was coated so as to have a thickness of 0.5 μm and dried.

Preparation of Image Receiving Sheet 6

On a 200 μm synthetic paper support (YUPO FPG #200, manufactured by Oji Yuka), which was treated with corona discharge processing on one side, same subbing layer-forming coating composition and image receiving layer forming composition as those employed in the image receiving sheet 5 were coated in the same condition on the discharged surface.

The image receiving sheet and the ink sheet thus obtained were evaluated as follow.

Print Sensitivity and Image Store Stability

Each color of Y (yellow), M (magenta) C (cyan) and K (black) digital images having 255-step gradation and 20-step gradation of were printed by employing the ink sheets and the image receiving sheet in combination by a sublimation type thermal transfer printer (CHC-S545, manufactured by SHINKO ELECTRIC INDUSTRIES CO., LTD.), and then the formed YMCK image was subjected to post heating treatment by the same thermal head (heating whole surface in combination the metal source containing layer with the image). YMCK density of 255-step gradation print was measured and is referred to the print sensitivity. The print samples were stored in isothermal condition at 60° C. and 80% RH, and under the radiation of xenon fade meter of 70,000 lux each for 3 months, and residual ratio of the image density at the D=1.0 before and after storage was evaluated. The density was measured by X-Rite 310TR.

Glossiness

Solid black image was printed on each of image receiving sheet by the sublimation type thermal transfer printer (CHC-S545, manufactured by SHINKO ELECTRIC INDUSTRIES CO., LTD.) using the obtained ink sheets and the image receiving sheets, subsequently, post heating was conducted on whole image by the same thermal head. Glossiness at printed area and non-printed area was measured by glossy meter (60° angle).

TABLE 1

| Sample No. | Image receiving sheet | Storage stability 60° C. 80% RH | Storage stability Xenon lamp radiation | Print sensitivity (Density) Y | M | C | K | Glossiness Solid black | White |
|---|---|---|---|---|---|---|---|---|---|
| 1 | 1 | 90% | 75% | 1.6 | 1.8 | 1.75 | 1.85 | 80.3 | 78.5 |
| 2 | 2 | 90% | 85% | 1.8 | 2.05 | 2.3 | 2.2 | 85.5 | 83.2 |
| 3 | 3 | 90% | 54% | 1.5 | 1.65 | 1.5 | 1.55 | 65.3 | 70.1 |
| 4 | 4 | 90% | 85% | 1.8 | 1.95 | 2.1 | 2.1 | 82.8 | 81.5 |
| 5 | 5 | 62% | 82% | 1.8 | 1.95 | 2.1 | 2.1 | 56 | 50 |
| 6 | 6 | 60% | 80% | 1.5 | 1.75 | 1.6 | 1.65 | 58.4 | 42.3 |

As shown in Table 1, according to the present invention excellent advantages are found in all of the image storage stability under severe condition, the print sensitivity and the glossiness

Example 2

The following experiment was conducted based on the thermal transfer recording material of Sample No. 1-2 (containing the ink sheet 1 and the image receiving sheet 2) in Example 1.

Preparation of Ink Sheet

The same ink sheet as ink sheet 1 in Example 1.

Preparation of Image Receiving Sheet 7

Image receiving sheet 7 was prepared in the same way as the preparation of Image Receiving Sheet 2, except that the plural layers described below were provide on the backside of the image receiving sheet 2 (side of porous PET sheet A).

On one side of transparent PET having specific gravity of 1.42 and thickness of 25 μm, which was formed by biaxially stretching, was subjected to corona discharge treatment, then the following subbing layer coating composition was coated on another side and the back coat layer coating composition described below was coated thereon so as to have dry thickness of 5 μm, and was dried for 2 minutes at 70° C., to form a back coat layer.

On the corona discharged side of transparent PET having thickness of 25 μm formed by biaxially stretching mentioned, above, a surface of high quality paper having thickness of 110 μm and smooth surfaces were faced to, and affixed by that polyethylene kneaded with titanium oxide was poured between them.

The another side of the high quality paper was affixed with the back side of the image receiving sheet (side of porous PET sheet A).

Subbing Layer Coating Composition (By Weight)

| | |
|---|---|
| Acryl binder (Movinyl8020, manufactured by Hoechst Synthesis Co.) | 20 parts |
| Water | 80 parts |

Back Coat Layer Coating Composition (By Weight)

| | |
|---|---|
| Saturated polyester copolymer binder (Byronar MD12000, manufactured by TOYOBO CO., LTD.) | 100 parts |
| Silica ((Mizukasolve C-1, manufactured by Mizusawa | 25 parts |

-continued

| | |
|---|---|
| Kagaku) | |
| Amphoteric surfactant (Disper 25N, manufactured by Miyoshi Oil and Fat Co., Ltd.) | 10 parts |
| Water | 70 parts |

The prepared image receiving sheet 7 composed of an image receiving layer containing styreneacrylonitrile and metal ion containing compound (MS-1), porous resin layer (porous PET sheet A) and a support having paper layer and further a backing resin layer comprising transparent PET layer.

The specific gravity is 0.7, and tensile elastic modulus is 156 $Kg/m^2$ of the porous resin layer (porous PET sheet A). That is, the tensile elastic modulus of the back resin layer was 2.6 times of that of the porous resin layer (porous PET sheet A).

Preparation of Image Receiving Sheet 8

The image receiving sheet 8 was prepared in the same way as the image receiving sheet 7 except that the back resin layer was replaced by transparent PET layer having thickness of 25 μm and further synthesized paper layer of polypropylene was provided.

The tensile elastic modulus of the synthesized paper layer of polypropylene was 40 $Kg/m^2$. Therefore, the tensile elastic modulus of the back resin layer was smaller than that of the porous resin layer (porous PET sheet A).

Comparative Silver Halide Photographic Paper

Konica color paper having an image formed by exposed and developed was employed.

Measurement and Evaluation (1) Measurement of Tensile Elastic Modulus

The tensile elastic modulus of each of the front and back sheets was measured in the following way and the result is shown in Table 1.

Measurement: Sample was prepared in the way that a film was cut in 10 mm×150 mm size, and measured by employing Tensilon tensile tester. The tensile elastic modulus was evaluated by relation of initial stretch and stress and cross section.

(2) Measurement of Stiffness

Tester: Stiffness tester, manufactured by Toyo Seiki.

Slide scale of sample holder: 5 mm.

Dial gauge (Inserting length of press needle): 1.0

The sample was deformed so as to be convex in the condition mentioned above, and the force detected by press needle was recorded when the press needle was entered by pressure.

The stiffness was measured in longitudinal and latitudinal directions and the value divided by 2 of the sum of the stiffness of longitudinal and latitudinal directions are shown in Table 2.

(3) Thickness

The thickness was measured by micrometer. The result is shown in Table 2.

(4) Incompatibility On Board

Estimation Method

Incompatibility was evaluated in such way that degree of the shadow around the print caused by the step of the print from the board was ranked when a sample print was affixed on a board, and the result is shown in Table 2.

Criteria

A; No incompatibility found at all.

B: No incompatibility found.

C: Incompatibility found.

D: Incompatibility found markedly.

(5) Measurement of Image Glossiness

Solid black image was printed on each of image receiving sheet by the sublimation type thermal transfer printer (CHC-S545, manufactured by SHINKO ELECTRIC INDUSTRIES CO., LTD.) using the obtained ink sheets and the image receiving sheets, subsequently, post heating was conducted on whole image by the same thermal head. Glossiness at printed area and non-printed area was measured by GLOSS METER (manufactured by Nihon Denshoku Kogyo Co., Ltd.) with incident angle at 60°.

(6) Curl Variation

Each of the image receiving sheets in size of A4 was allowed to stand under the condition of 23° C. and 55% RH for three days, it was placed on a level table, the rising curl at the quarters was measured under the same condition and the average value "A" was obtained. The rising curl is shown by plus or minus value when the surface of the image receiving side is concave or convex respectively. In determining plus or minus, the larger case of the average of the rising is selected. On the other hand, the rising curl was obtained after staying three days under the condition of 23° C. and 80% RH. The average value was referred to "B". The Curl variation is represented by the difference of A from B.

TABLE 2

| Sample No. | Image Receiving Sheet | Tensile elastic modulus (kg/m²) Porous Resin Layer | Back Resin Layer | Stiffness | Thickness (μm) | Incompatibility when affixed | Glossiness of Image | Curl Variation |
|---|---|---|---|---|---|---|---|---|
| 2-1 | 7 | 156 | 400 | 42 | 225 | A | 87 | 2 |
| 2-2 | 8 | 156 | 40 | 37 | 225 | A | 87 | 17 |
| 2-3 | — | — | — | 40 | 220 | A | 93 | 10 |

It is apparent from the Table 2, Sample No. 2-1 is a thermal transfer recording material which has high stiffness parallel to silver halide photographic paper, no incompatibility when affixed on a board, high glossiness of image surface and low curl variation, caused by having a back resin layer with higher tensile elastic modulus than that of the porous resin layer.

On the contrary Sample 2-2 does not comprises a back resin layer with higher tensile elastic modulus than that of the porous resin layer. The incompatibility problem is dissolved since the sample has the same thickness. However, performance is degraded in stiffness and curl variation.

Example 3

The following experiment was conducted based on the thermal recording material of Sample No. 1-2 (Ink sheet 1 and Image receiving sheet 2) in Example 1.

Preparation of Ink Sheet 2-18

Ink sheet 2-18 was prepared in the same way as ink sheet 1 in Example 1 except that the post-chelate dye (d) was replaced by those described in Table 3.

Preparation of Image Receiving Sheet

The same image receiving sheet was prepared as the image receiving sheet 2 in Example 1.

Thermal Image Recording

Each color of Y (yellow), M (magenta) C (cyan) and K (black) digital images having 255-step gradation and 20-step gradation of were printed by employing the ink sheets and the image receiving sheet in combination by a sublimation type thermal transfer printer (CHC-S545, manufactured by SHINKO ELECTRIC INDUSTRIES CO., LTD.), and then the formed YMCK image was subjected to post heating treatment by the same thermal head (heating whole surface in combination the metal source containing layer with the image) to obtain image 1-18.

Measurement and Evaluation

Maximum density, sensitivity, image storage stability and color reproduction of the obtained image was evaluated in accordance with the following way.

Maximum Density

Maximum reflective density (a portion of maximum exposing time, usually) was measured by a densitometer X-Rite 310TR, manufactured by X-Rite Co., Ltd.

Sensitivity

Relative applied energy necessary to obtain density of 1.0 assuming the energy for sample 1 being 1. The smaller the value is represented, the higher sensitivity is shown.

Stability to Humidity and Heat

The stability of dye after storage under the condition of 85° C. and 60% RH for 7 days was estimated. The residual ratio of dye after 7 days is shown. The residual ratio of dye is represented by $D/D_0 \times 100$ (%), wherein $D_0$ and D are the density before and after storage.

Color Reproduction

Tone of the obtained cyan image was evaluated by eye viewing. The evaluation was shown by 5 ranks, and 5 is the best.

The results are shown all in Table 3.

TABLE 3

| Image No. | Ink Sheet No. | Dye | Maximum Density | Sensitivity | Stability (%) | Color Reproduction |
|---|---|---|---|---|---|---|
| 1 | 1 | (d) | 2.02 | 1.00 | 88 | 4 |
| 2 | 2 | Exemplified Compound 1 | 2.14 | 0.92 | 92 | 4 |
| 3 | 3 | Exemplified Compound 2 | 2.19 | 0.98 | 91 | 4 |
| 4 | 4 | Exemplified Compound 3 | 2.22 | 0.95 | 90 | 4 |
| 5 | 5 | Exemplified Compound 4 | 2.15 | 0.96 | 91 | 4 |
| 6 | 6 | Exemplified Compound 7 | 2.13 | 0.92 | 95 | 5 |
| 7 | 7 | Exemplified Compound 10 | 2.16 | 0.91 | 93 | 5 |
| 8 | 8 | Exemplified Compound 16 | 2.07 | 0.92 | 96 | 5 |
| 9 | 9 | Exemplified Compound 20 | 2.25 | 0.89 | 97 | 5 |
| 10 | 10 | Exemplified Compound 27 | 2.16 | 0.86 | 98 | 5 |
| 11 | 11 | Exemplified Compound 32 | 2.23 | 0.84 | 96 | 5 |
| 12 | 12 | Exemplified Compound 34 | 2.17 | 0.85 | 98 | 5 |
| 13 | 13 | Exemplified Compound 38 | 2.12 | 0.92 | 98 | 5 |
| 14 | 14 | Exemplified Compound 42 | 2.16 | 0.86 | 95 | 5 |
| 15 | 15 | Exemplified Compound 48 | 2.08 | 0.86 | 98 | 5 |
| 16 | 16 | Exemplified Compound 51 | 2.06 | 0.89 | 97 | 5 |
| 17 | 17 | Exemplified Compound 55 | 2.05 | 0.90 | 95 | 5 |
| 18 | 18 | Exemplified Compound 60 | 2.03 | 0.84 | 98 | 5 |

It is apparent from table 3 that the thermal transfer ing material employing dye having pyrazolopyrimidine-7-one structure is higher sensitive, and gives an image with high density and good image storage stability.

What is claimed is:

1. A thermally transferable recording material to form an image by sublimating a thermally transferable dye, which material comprises an image receiving sheet capable of accepting thermally transferable dye and having a first support, an image receiving layer provided on the first support, and a back resin layer on the opposite site of the image receiving layer with reference to the first support, wherein the image receiving layer comprises a metal ion containing compound, capable of forming a chelate with the thermally transferable dye and an acryl resin composed of styrene and acrylonitrile as component unit, the first support comprises a porous resin layer, and the back resin layer has a tensile elastic modulus higher than that of the porous resin layer.

2. The thermally transferable recording material of claim 1 wherein the metal ion containing compound is represented by MX, wherein M is a monovalent or poly valent metal belong to Group I through Group VIII of the periodic table, X represents

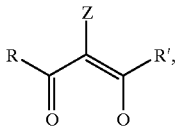

wherein Z is an alkyl, aryl, alkoxy, acyl, alkoxycarbonyl, carbamoyl group, a halogen or hydrogen atom; R and R' represent an alkyl or aryl group, each of which may be same or different, ring may be formed by boding R with Z or R' with Z, with proviso that R and R' are not methyl group simultaneously when Z is hydrogen atom.

3. The thermally transferable recording material of claim 1 wherein the acryl resin comprises acrylonitrile-styrene resin.

4. The thermally transferable recording material of claim 1 wherein the first support further comprises a paper layer, and the porous resin layer is provided between the paper layer and the image receiving layer.

5. The thermally transferable recording material of claim 4, wherein the back resin layer comprises a resin layer and a coating layer formed by coating an aqueous dispersion of resin.

6. The thermally transferable recording material of claim 5 wherein a resin of the coating layer of aqueous dispersion of resin is a hardenable resin.

7. The thermally transferable recording material of claim 1 wherein the porous resin layer contains polyester.

8. The thermally transferable recording material of claim 7 wherein the polyester contains polyethylene-terephthalate.

9. The thermally transferable recording material of claim 1 wherein the tensile elastic modulus of the back resin layer is more than 1.5 times that of the porous resin layer.

10. The thermally transferable recording material of claim 1 wherein the tensile elastic modulus of the back resin layer more than 2.0 times of that of the porous resin layer.

11. The thermally transferable recording material of claim 1 wherein the porous resin layer has specific gravity of 0.5 to 0.9.

12. The thermally transferable recording material of claim 1 wherein the image receiving sheet comprises a back coat layer containing fine particles of inorganic or organic compound and binder on the opposite side of the porous resin layer with reference to the support.

13. The thermally transferable recording material of claim 12 wherein the back coat layer contain an antistatic agent.

14. The thermally transferable recording material of claim 1 wherein the thermal transfer recording material comprises an ink sheet comprising a second support and an ink layer provided on the second support, and the ink sheet contains the thermally transferable dye.

15. The thermally transferable recording material of claim 14 wherein the thermally transferable dye is represented by the formula (I)

(I)

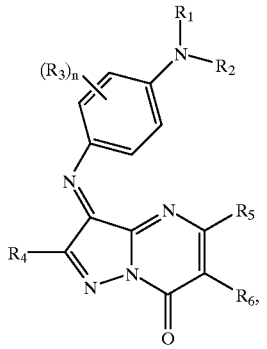

the formula, $R_1$ and $R_2$ independently represent a substituted non-substituted alkyl group, $R_3$ represents a substituent. n an integer of 0 to 4, $R_3$ may be same or different when n is 2 more, $R_4$ is a straight chain alkyl group having two or more carbon atoms, a cycloalkyl, branched alkyl excepting tertiary alkyl, aryl, alkoxy, aryloxy or amino group, $R_5$ and $R_6$ independently represent a hydrogen atom or a substituent.

16. The thermally transferable recording material of claim 15 wherein $R_4$ or $R_5$ is an aryl group having a substituent at ortho position.

17. The thermally transferable recording material of claim 15 wherein at least one of $R_4$, $R_5$ and $R_6$ is a branched, but not tertiary, alkyl group.

* * * * *